US011937714B2

(12) United States Patent
Renz et al.

(10) Patent No.: US 11,937,714 B2
(45) Date of Patent: Mar. 26, 2024

(54) TRAINING CUP

(71) Applicant: JMBH Holdings, LLC, Shelton, CT (US)

(72) Inventors: Charles Renz, Shelton, CT (US); Robert F. Rosasco, III, Shelton, CT (US)

(73) Assignee: JMBH Holdings, LLC, Shelton, CT (US)

( * ) Notice: Subject to any disclaimer, the term of this patent is extended or adjusted under 35 U.S.C. 154(b) by 387 days.

(21) Appl. No.: 16/986,955

(22) Filed: Aug. 6, 2020

(65) Prior Publication Data

US 2020/0359816 A1 Nov. 19, 2020

Related U.S. Application Data

(63) Continuation of application No. PCT/US2018/044287, filed on Jul. 30, 2018.

(60) Provisional application No. 62/626,889, filed on Feb. 6, 2018.

(51) Int. Cl.
*A47G 19/22* (2006.01)
*B65D 47/32* (2006.01)

(52) U.S. Cl.
CPC ..... *A47G 19/2272* (2013.01); *B65D 47/32* (2013.01); *B65D 2543/00046* (2013.01); *B65D 2543/00092* (2013.01)

(58) Field of Classification Search
CPC ..... B65D 47/32; B65D 2543/00092; B65D 2543/00046; B65D 47/246; B65D 43/0229; B65D 2251/20; A47G 19/2272
USPC ..... 220/203.16, 231, 703, 711, 714
See application file for complete search history.

(56) References Cited

U.S. PATENT DOCUMENTS

| | | | | |
|---|---|---|---|---|
| 9,149,138 | B2 * | 10/2015 | Miller | A47G 19/22 |
| 2011/0084084 | A1 | 4/2011 | Berg | |
| 2015/0102032 | A1 | 4/2015 | Dunn | |
| 2018/0279815 | A1 * | 10/2018 | Hakim | B65D 25/2802 |

FOREIGN PATENT DOCUMENTS

WO WO 2019/156709 8/2019

OTHER PUBLICATIONS

International Search Report and Written Opinion Issued in Corresponding PCT Patent Application No. PCT/US2018/044287, dated Dec. 14, 2018.
International Preliminary Report on Patentability Issued in Corresponding PCT Patent Application No. PCT/US2018/044287, dated Aug. 11, 2020.

* cited by examiner

*Primary Examiner* — James N Smalley
*Assistant Examiner* — Madison L Poos
(74) *Attorney, Agent, or Firm* — Getz Balich LLC

(57) ABSTRACT

A container assembly includes a container (or cup) and a lid, and functions as a training cup assembly. The lid activates by a force applied by the user of the cup in order to withdraw fluid from inside the cup volume. The training cup feature permits removal of the contents from the cup while mitigating against leaks and/or spills.

5 Claims, 13 Drawing Sheets

TRAINING CUP

CROSS-REFERENCE TO RELATED APPLICATIONS

This application is a continuation of International Application No. PCT/US2018/044287, filed Jul. 30, 2018, which claims priority to U.S. Provisional Patent Application Ser. No. 62/626,889, filed Feb. 6, 2018, the contents of which are incorporated by reference herein.

BACKGROUND OF THE PRESENT DISCLOSURE

A. Field of Endeavor

The present disclosure relates to cups for young children. More particularly, the present disclosure relates to cup assemblies that assist in training young children how to drink.

B. Background Information

Child cups seek to conform to the needs of a child and/or a caretaker. Child cups having handles, cups with spouts or straws, and cups that mitigate against fluid escaping the container other than by the spout or straw are known.

It is desirous to have not only a cup assembly and/or container assembly that mitigates against leaks, but also suits the feeding needs of the child, and/or the use or habits of the caretaker, while appealing to the child and optionally assisting the child in his or her development.

Cups that mitigate against spills while having a shape similar to an adult cup are desirous, but prior attempts at achieving such cups have shortcomings. The present disclosure seeks to alleviate deficiencies of the prior art.

SUMMARY

The present disclosure provides a training cup or container assembly. The term "container assembly" as used herein is inclusive of vessels and containers used by children and/or infants for feeding or activities related to feeding, such as food containers and liquid containers, as well as their related parts. Similarly, the term "container" is inclusive of vessels and containers used by children and/or infants for feeding or activities related to feeding, such as food containers and liquid containers. The cup assembly includes a connection means, connecting means, or connecting feature (press-fit, snap-fit, interference fit, detent connection, latch, threads, helical threads, bayonet tracks, male/female connection, hybrids thereof, etc.) securing the lid to the cup or container. The training cup assembly (or container assembly) permits withdrawal of the contents. The child exerts a force on a flexible valve which deflects and permits fluid to bypass the flexible valve through an opening (or fluid path) created between the flexible valve and the interior of the cup (such as the interior of the cup lip and/or cup platform). The flexible valve is biased to be in a closed state, such that, upon release of the force exerted by the child, the flexible valve creates a seal and mitigates against spills in the event the cup is tipped over. In this manner, the training cup responds to suction force (and/or by deflecting the flexible valve with the child's lip/mouth) exerted by the child's mouth against the flexible valve. When the suction force (and/or other force causing deflection of the flexible valve) is exerted, the flexible valve permits fluid to flow through one or more openings in a baffle and thereby enables the user to drink. The suction force (and/or other force causing deflection of the flexible valve) exerted by the child helps the child to progress from drinking from (1) containers utilizing suction such as bottles with nipples, and also sippy cups with straws or spouts, to (2) drinking from an open rim cup, while mitigating against spills and/or leaks. In other words, the child has learned to apply suction from a rounded structure such as a nipple, spout or straw, and the cup assembly of the present disclosure transitions the child to use of suction force to a more elongate shape such as the rim (or lip) of a cup, such that the child learns the proper lip positioning to learn to sip from an open-rim cup. Furthermore, such a cup can be tipped like an open-rim cup to reinforce how to get the fluid to the rim of the cup to be consumed. As the user stops applying suction (and/or other force causing deflection of the flexible valve) to the flexible valve, the flexible valve returns to its initial position thereby preventing fluid from flowing out of the opening(s) in the baffle.

Another aspect of the present disclosure resides in a simplified cup having two components a lid and a cup. The lid and/or cup may, individually, include many non-integral parts, but the cup in of this configuration is designed to reduce assembly or cleaning complexity such that it is easy to use (particularly while providing care for one or more children, or providing care while holding a child in one arm and thus having only one other arm/hand to fill and close the cup). Some prior art cups have blind openings that cannot be easily and properly cleaned; it requires disassembling at least two lid components that can be difficult to separate and/or properly reassemble. The cup of the present disclosure alleviates this by (a) having only two parts and/or (b) a structure without small (or blind) recesses that are difficult to access. In some embodiments, the lid (or valve cap) is a single piece made of a thermoplastic material with a durometer of about 30 to about 70. The single piece lid (or valve cap) has varying thickness to achieve various functions. For instance, the valve cap has thinner more flexible portions, and thicker more rigid portions. Cleanability is in part a function of having a clearance between the baffle and the flexible valve sufficient to enable water to pass-through to clean and rinse, and preferably, the clearance enables a small brush to access all surfaces between the baffle and the flexible valve.

Another aspect of the present disclosure resides in simplified assembly of the cup. In one embodiment, the lid has a cup connection means to the cup, and likewise the cup has a lid connection means to the lid, that provide, for example, a press-fit, friction-fit or a snap-fit connection between the lid and cup. Once the snap-fit, friction-fit, or press-fit connection is achieved, the lid is fixed into place for use with the cup. The cup's lid connection means includes a lip or a rib. When the lid is press-fit, friction-fit, or snap-fit to the cup, the user is aware of the connection by an audible and/or tactile sensation when the cup connecting means slide over the lid connecting means (or vice-versa, depending on how the cup and lid are positioned with respect to each other). When the cup is empty and it needs to be opened for refill or cleaning, the user pushes on one side of the lid to release the lid from its fixed position, causing the opposite side of the lid to rotate upward, enabling the user to grasp the opposite end and remove the lid from the cup.

In another embodiment, the cup has a tapered wall assembly permitting a press-fit connection between the inner wall of the cup and the lid. The tapered wall in this instance is the cup's connecting means. The user simply pushes the lid downward into the cup until a sufficient resistance is felt (approximately 10-40 lbs). The user will also see the upper periphery of the lid align proximal to the upper outer periphery of the cup. Both the resistance and the visual alignment signal to the user that the cup is ready for use. To remove the lid, the user pushes on one side of the lid to release the lid from its fixed position, causing the opposite side of the lid to rotate upward, enabling the user to grasp the opposite end and remove the lid from the cup.

In another embodiment, the lid engages the cup via a threaded connection. The lid is rotated into the cup to establish a secured condition that is ready for drinking. Upon rotation in the direction opposite the rotation of connection (example—counterclockwise loosens the lid while clockwise tightens), the user can refill or clean.

In another aspect of the present disclosure, the cup lid has a handle or knob to assist in assembly. The handle or knob is located generally centrally and extends along the vertical axis. The handle or knob protrude upward along the central vertical axis of the lid (and when connected to the cup, along the central vertical axis of the cup). The handle or knob is suitably sized to accommodate an adult user's hand, typically a thumb and at least one finger. The handle or knob is suitably sized not to interfere with a child's face when the child engages the cup to drink.

In another aspect of the present disclosure, the cup lip, located about the upper outer periphery of the cup is outward and upward of the upper outer periphery of the cup. This geometry is unique and promotes (a) a training cup that looks similar to an adult cup as the lid is not seen from an elevation view of the cup (in some embodiments, it operates as a plug as opposed to an overriding collar that is outward of the cup or proud with respect to the cup), and (b) the flexible valve creates a sealed condition with the cup such that any residual fluid is pushed downward and inward towards the cup inner volume as opposed to out of the cup about the upper outer periphery of the cup, causing drips. In some embodiments, the cup lip is beaded, has a lead-in, is tapered, or is rounded where width or radius of the lip is greater than the thickness of the edge of the flexible valve. This helps to further reduce drips by creating a further tortuous path. In any event, the cup lip looks akin to a normal cup lip from an elevation view. In some such embodiments, the height of the lid is less than or equal to the height of the cup when the lid and the cup are fully connected. In some embodiments, the largest outer periphery of the lid defines a lid outer perimeter, and the largest outer periphery of the cup defines a cup outer perimeter, where the lid outer perimeter is less than or equal to the cup outer perimeter when the lid and the cup are fully connected.

In yet another aspect of the present disclosure, the cup reduces spills. As mentioned above, the geometry of the cup lip and the edge of the flexible valve create an improved seal, thereby further mitigating against spills when the cup is tipped-over.

In another aspect of the present disclosure, the cup is a single piece. In known training cups, the lid adds onto the total height of the cup, and acts as the cup lid. In these embodiments, the lid must be assembled onto the cup about the upper periphery of the cup, thereby creating an additional opportunity for leaks.

In another aspect of the present disclosure, the cup assembly has improved spill and leak characteristics. Due to the aforementioned threaded connection of some embodiments, the cup lid having both a baffle and a flexible valve is secured with respect to the cup connecting means to the cup. In prior art cup assemblies, the lid has a first component including a baffle that is connected to the cup. The lid has a second component including a flexible valve that snap-fits onto the lid's first component. This second component is susceptible to popping-off upon the cup being tipped-over or dropped, particularly if the cup is full (where the fluid creates a high impulse force directed to the lid's second portion). The present disclosure's single connecting means of the lid to the cup alleviates such potential issues.

In yet another aspect of the present disclosure, the cup assembly has an improved sealing feature. In such embodiments, the cup provides an audible or tactile indication to the user that the lid and cup have been securely fastened together. In such embodiments, one or more protrusions such as one or more detents or ribs is located outward and/or above the cup connecting means on the lid. One or more recesses is located outward and/or above the lid connecting means on the cup. Once the lid is connected to the cup (or vice-versa), the one or more protrusions engages the one or more recesses thereby providing an indication to the user that a proper connection (and seal) has been achieved between the lid and the cup. In some embodiments, one or more detents extends outwardly from the outer edge of the second portion (or lower portion) of the lid, where the outer edge is above of the threads.

The prior art includes configurations where the cup lip is in a first lid piece that connects to the top of the cup. To ensure a sufficient seal, a gasket is often employed. To be certain this first lid is suitably clean, the gasket should be removed from time to time to enable proper cleaning and air flow/drying between the portions of the gasket that touch or close-off surfaces of the first lid piece. This configuration induces an additional point where leakage can occur and requires additional parts (such as the gasket) thereby increasing manufacturing cost and furthermore, requires separation for cleaning.

The prior art also includes configurations where the cup lip and baffle are in a first lid piece (or collar) that connect to the top of the cup. In other words, this first lid piece with the cup lip and baffle are generally at the uppermost part of the cup and extend above the cup. The flexible valve is in a separate piece attachable to the first lid piece. In yet another aspect in embodiments of the present disclosure, the cup lip is independent from the baffle—the cup lip is on the cup and not on the lid, nor is it on the same piece as the baffle. The cup lip is on the cup as opposed to on a component that makes-up the lid. The baffle and the flexible valve are in a unitary lid that are not meant to be separated by the user.

In yet another aspect of embodiments of the present disclosure, the cup has greater utility after the child has transitioned into an open cup. In prior art embodiments, the cup lid extends the height of the cup, and includes the lip of the cup. The first component of the cup lid that has the lip of the cup also includes the baffle. If the user simply removes the lid second component, the lid first component is required in order to have a cup lip. The cup in this configuration does not look like a typical open-rim cup and can be unattractive/unwanted by the child (who is likely proud of becoming old enough to drink from an open rim cup). If the lid first component is removed, it reveals a cup that is shortened by about 25 mm to 51 mm (about one to two inches), and reveals a cup that (a) does not have a lip and (b) has threads proximal the lip that can be less than comfortable to drink from. Further, the cup is left with a connection means where the lid first component connects to the cup. As such, the resulting cup, while not looking as odd (from a top down view as the child is attempting to drink) as the cup with the first lid component, it is not necessarily a comfortable cup to drink from due to the absence of a lip and/or the existence of connection means on the cup still present proximal the upper portion of the cup. Further, the cup is short, thus having a smaller volume and looking less like a normal open cup and more so like a smaller child's cup.

In contrast and as stated above, the present disclosure's cup has a cup lip. As such, once the child transitions to an open rim cup, the user simply removes the lid and the cup remains in its original size (thus having a greater volume than prior art cups of the same overall footprint, and the present disclosure's cup looks like a normal cup not a smaller child's cup) and with a cup lip. Further, the present disclosure's cup connecting means are distal from the cup lip, thereby improving comfort by the child while the child is drinking.

In an alternate embodiment of the present disclosure, the cup assembly includes a lid that connects above the upper end of the cup. The lid (or valve cap) includes a lip, a flexible valve, and a baffle. In this embodiment, the lid has a lip. Upon removal of the lid, the cup also has a lip feature such that the cup has multiple configurations that are improved for drinking, and offers a short cup version and a tall cup version. The cup's lip feature permits connection to the lid while mitigating against spills.

In another embodiment of the present disclosure, the container assembly is a hybrid assembly. The container assembly is optionally a cup assembly having a lid similar to the aforementioned configurations. The container assembly is optionally a food storage container. In this embodiment, the container assembly has a lid that engages the container similar to the aforementioned lid and cup configurations. To assist in opening and closing the lid, a knob or handle as described above is provided. Alternatively, a handle located about the periphery of the lid that extends upward, outward and then downward over at least a portion of the exterior of the container assists, in opening and closing. The container assembly is optionally a snacker. In this embodiment, the container assembly has a lid with flexible petals permitting a user to push one's hand past the petals thereby biasing the petals downward in order to retrieve some of the contents of the container and withdraw the contents grasped upward and outward of the petals. In this embodiment, the lid engages the container similar to the aforementioned lid and cup configurations. To assist in opening and closing the lid, a handle located about the periphery of the lid that extends upward, outward and then downward over the container assists in opening and closing. The handle in this embodiment serves not only as a means to open and close, but also a means to hold and carry the container.

In some embodiments, the cup or container assembly afford two lids to be attached to the cup at the same time. In some embodiments, a first lid is connected to a container. The first lid is suitable to close the container such that the contents cannot escape the container, or the lid enables the contents to escape such as in the snacker or cup configurations described above. A second lid is attachable to the first lid and/or the container. In such configurations, an additional lid is provided to further mitigate spills during transit. In such configurations where the snacker lid is the first lid and the cup lid is the second lid, a child can still drink from the container without removing the snacker lid. Such configurations are unique and afford interchangeability of various feeding containers and components.

Such multipurposed feeding container embodiments optionally have a slightly wider and optionally shorter shape to accommodate a child's hand, as well as solid foods as well as liquid foods requiring a utensil (spoon, fork, spork) and optionally provides a utensil that matingly engages (via snap-fit, press-fit, friction fit, latch, male/female engagement, clip, hook, expansive/elastomeric members, other connecting means, or combinations thereof) the handle or other portion of the container assembly. In some embodiments, the utensil forms the handle. In yet other embodiments, the utensil has two connecting means to the handle to form an elongate handle and sturdy handle. In yet other embodiments, the container assembly has two handles, including a first utensil connecting to and extending a first handle, and a second utensil connecting to and extending the second handle. In some of these embodiments, the connecting means are about the handle-end of the utensil. In other embodiments, the food-end of the utensil connects to the container assembly handle thereby mitigating against dirt prior to use.

In some embodiments of the present disclosure, the cup has one or more of the aforementioned aspects.

DETAILED DESCRIPTION OF THE PRESENT DISCLOSURE

Figure 1:
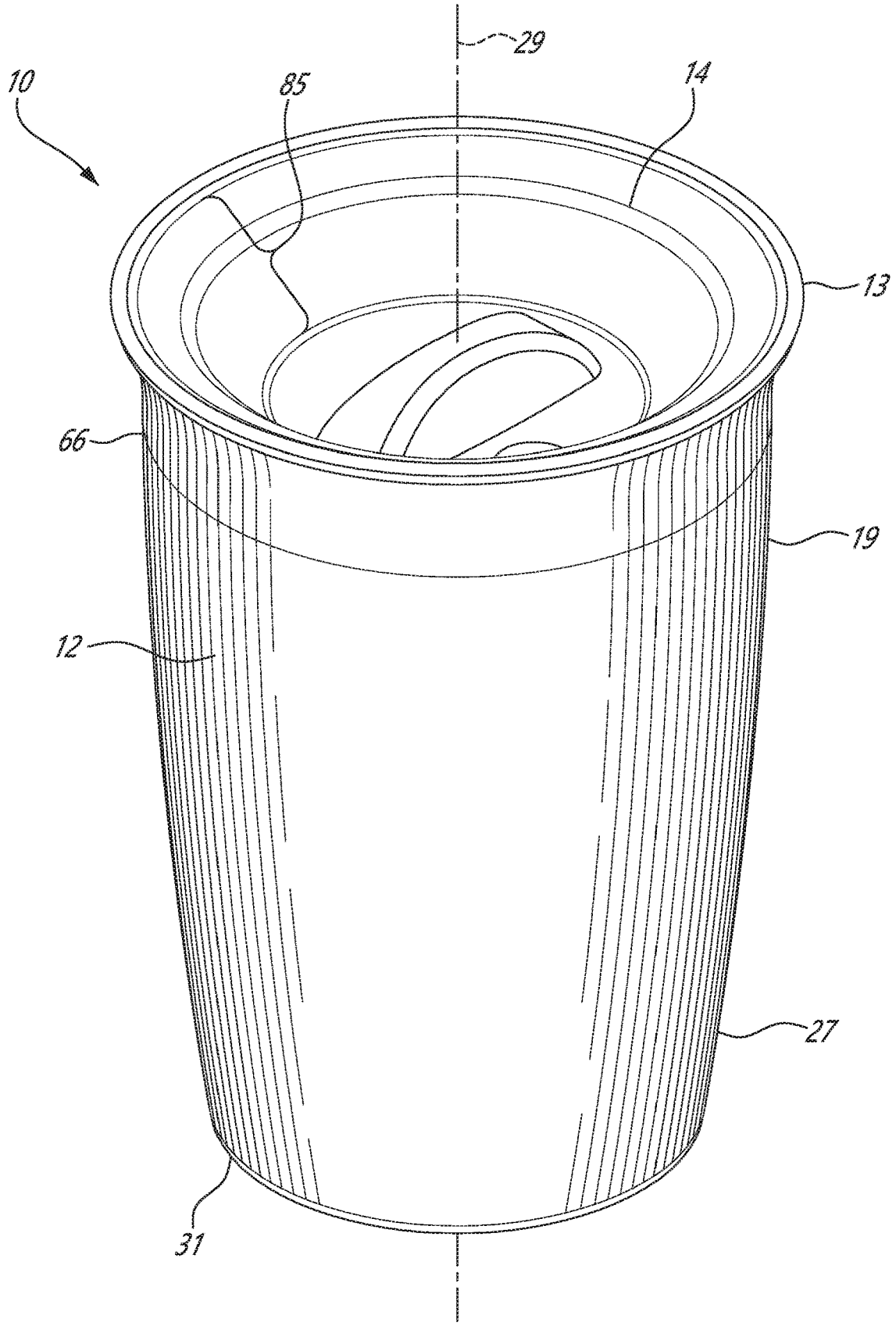
FIG. 1 is a front angled view of a cup assembly embodiment of the present disclosure.

The figures represent various embodiments of cups and containers that mitigate against spills. Referring generally to FIG. 1, the cup (or container) assembly 10 of the present disclosure includes a cup (or container) 12 and a lid 14. The cup (or container) assembly 10 has a central vertical axis 29 The lid 14 is also referred to as a valve cap 14 or plug, optionally as collar, and as by other terms such as cover 16 and snacker lid 15 for the various embodiments throughout the present disclosure. The cup (or container) 12 has a cup (or container) vertical axis 104, and the lid 14 (or valve cap) also has a lid vertical axis 102. When the cup 12 and lid 14 are fully connected (or fully-assembled), the cup vertical axis 104 and the lid vertical axis 102 are substantially coaxial and/or coterminous with the central vertical axis 29 and to each other.

Figure 2:
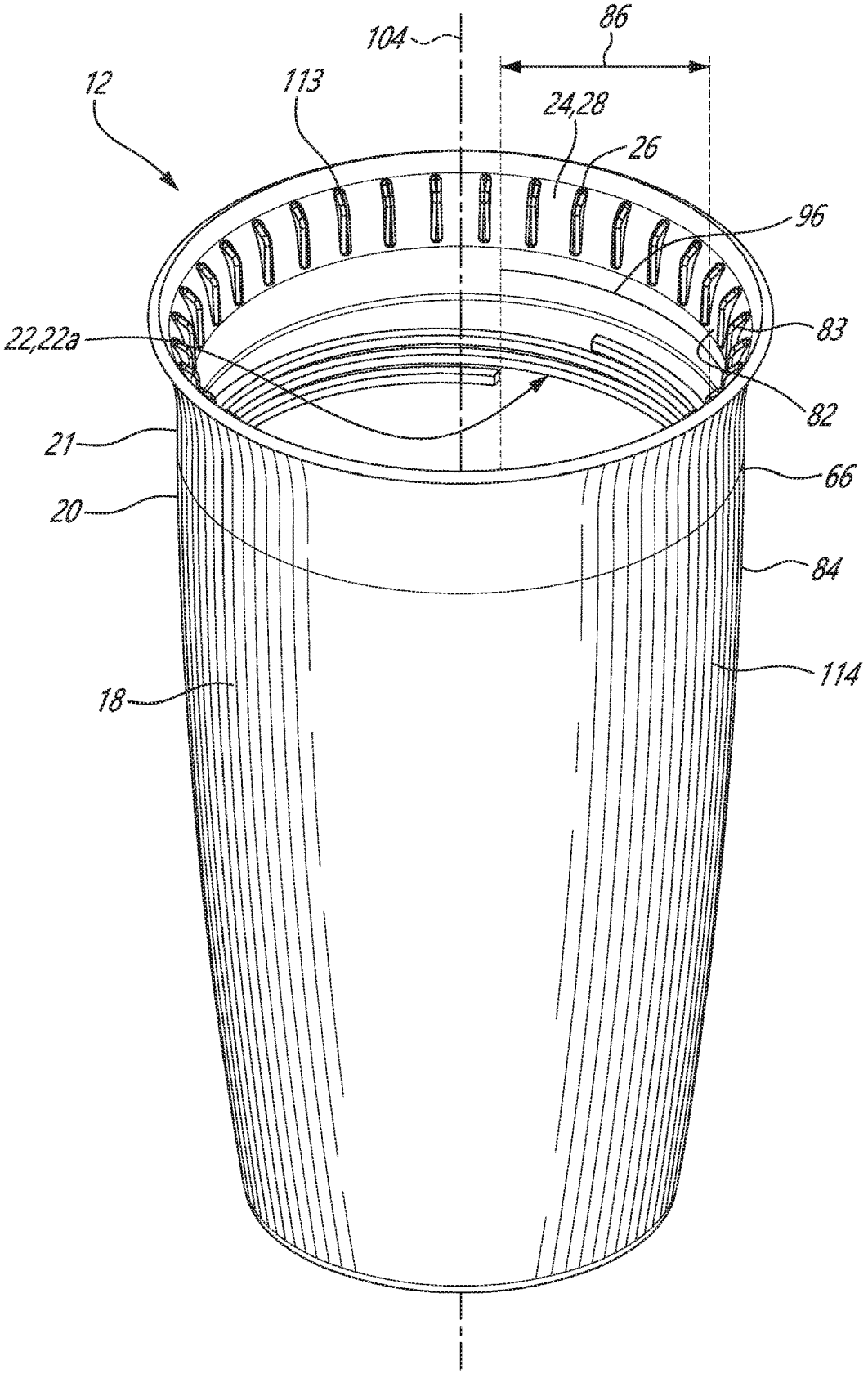
FIG. 2 is a front angled view of a cup embodiment of the present disclosure.
Figure 3:
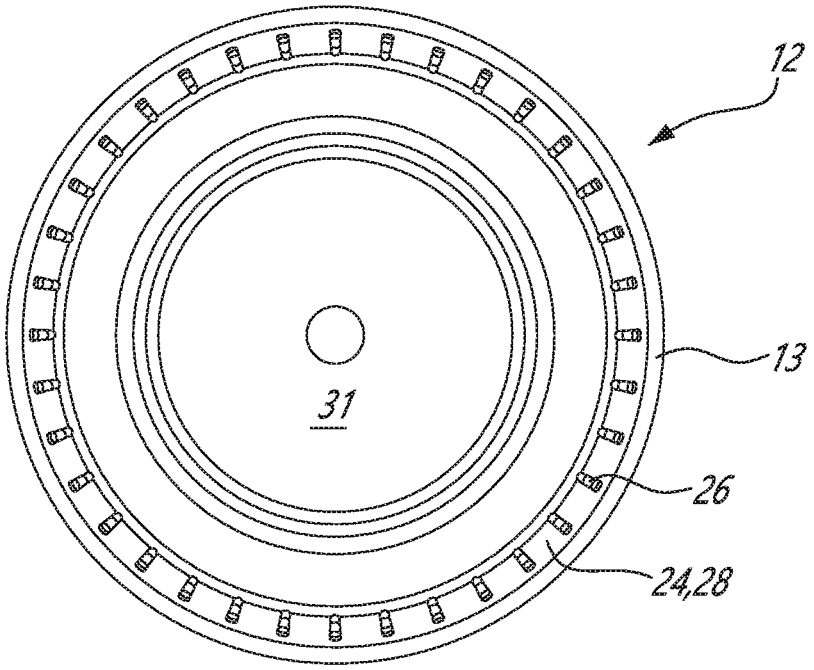
FIG. 3 is a top view of a cup embodiment of the present disclosure.

As exemplified in FIG. 2, The cup 12 includes an upper portion with a lip 13 located about the upper outer periphery of the cup 12. The lip 13 is optionally beaded or rounded, having a lip width 25 that is between about 1.0 mm to about 4 mm, and more preferably between about 1.5 mm and about 2.5 mm. Lip radius 25*a* is between about 0.25 mm and about 4 mm, and more preferably between about 0.5 mm and about 2 mm. Lip 13 is optionally angled or tapered, having a lead-in suitable for drinking or to engage with valve 48 as described below. Proximal and inferior to the cup lip 13 is a platform (or valve seat) 17. The platform 17 is angled downward towards the cup 12 volume. The platform 17 is optionally chamfered or arcuate. The platform 17 is at an angle to the lip 13. In some embodiments, the platform 17 varies in thickness to accommodate manufacturing preferences while providing a suitable surface for the flexible valve 48 to mate to and provide a seal in a rest (non-use) state. Albeit a rest (or non-use) state, the flexible valve 48 may exert a force against the platform 17 and/or lip 13 in order to ensure the cup assembly 10 maintains a seal between such components upon being tipped to mitigate against spills.

The cup 12 includes a cup body 18 suitable for retaining and storing a volume of liquid (or other material such as solid foods). The cup (or container) 12 has a width (or diameter) 65 at its upper end at the lip 13 of between about 40 mm and about 120 mm, or more preferably between 60 mm and about 90 mm. The cup (or container) 12 has a cup height 64 between about 50 mm to about 140 mm. For cup embodiments, the cup 12 is more preferably between about 90 mm and about 140 mm. For container 12 embodiments, the container 12 is more preferably between about 50 mm and about 90 mm.

The cup body 18 has a connection portion 21, an upper wall 19 adjacent the connection portion 21, and a lower wall 27. The connection portion 21 includes lid connecting means 22 such as threads 22*a* as defined above, and/or a lip 22*b*. In other embodiments, the connection portion 21 includes a taper 20 in the cup body 18. The connection portion 21 is distal from the upper portion of the cup proximal upper outer perimeter (as exemplified by lip 13). In some embodiments, the outer perimeter of lip 13 is the largest perimeter of the cup (or container) 12 and cup (or container) assembly 10.

The cup 12 defines channels 24 for fluid flow. The channels 24 are in the upper end of the cup 12 proximal the cup lip 13. The channels 24 are defined by spacers 26 exemplified in FIG. 2 as ribs. In some embodiments, the channels 24 are recesses 28, either with respect to the inner surface of the cup 12 and/or with respect to the height of the spacers 26. In some embodiments, spacers 26 and/or recesses 28 that define channels 24 are located on the cup 12 inner wall 114 located in the upper wall 19 proximal the cup upper perimeter (lip 13). The channels 24, spacers 26, and/or recesses 28 are proximal the valve seat 17, extending the valve seat 17 and/or creating a surface by which the cup 12 and flexible valve 48 interact to form a seal. In some embodiments, spacers and/or recesses 28 that define channels 24 are located on the lower surface 69 of the flexible valve 48 proximal the outer edge 49 of the first portion (or upper portion) 50 of the flexible valve.

As exemplified in FIG. 1, the cup 12 can have a taper such that the lower wall 27 is slightly narrower than the upper wall 19. In some embodiments, the cup lower wall 27 is only slightly narrower than the upper wall 19 in order to maintain balance and keep the cup's 12 center of gravity from being too high up. As exemplified in FIG. 1, the lip 13 has the largest perimeter or is the widest portion of the cup 12.

In some embodiments, the cup 12 has a fill line 66 located below the connection portion 21. In some embodiments, the fill line 66 is located above the inferior-most portions of second portion 54 (of lid 14) but slightly below the portion of baffle 59 with opening(s) 57. The fill line 66 is located such that it can be seen inside the cup 12 while fluid is being added. In embodiments where the cup is at least partially translucent or has a window, the fill line is visible on the outside of the cup 12 as well. In some embodiments, the fill line 66 designates the separation of the connection portion 21 (above the fill line 66) from the upper wall 19 (below the fill line 66). In some embodiments, the fill line 66 designates a change in curvature where the width (or diameter) 65 of cup 12 becomes larger towards lip 13. Optionally, fill line 66 also designates the uppermost portion of the cup 12 where graphics can be easily applied to the cup. In embodiments where the lid 14 is in the form of a collar, the fill line 66 designates where the outer wall 112 of the lid 14 connects with the outer wall 114 of the cup 12.

The cup body 18 has a thickness 23 that can be constant or vary along the entirety of the cup body 18. The cup thickness 23 is typically uniform about a horizontal slice along the central vertical axis 29 (with the exception of any variation in thickness due to lid connecting means 22 and/or where handles 30 connect to cup body 18), and/or also amongst vertical radial slices about the central vertical axis 29 (except where, for instance other cup or container 12 features exist, such as where one or more handles 30 connects to the cup or container 12). In some embodiments, the cup 12 has an upper wall thickness 33 that has a greater thickness (in at least some portion of the upper wall 19) than at least some portion of the lower wall thickness 34.

Figure 4:
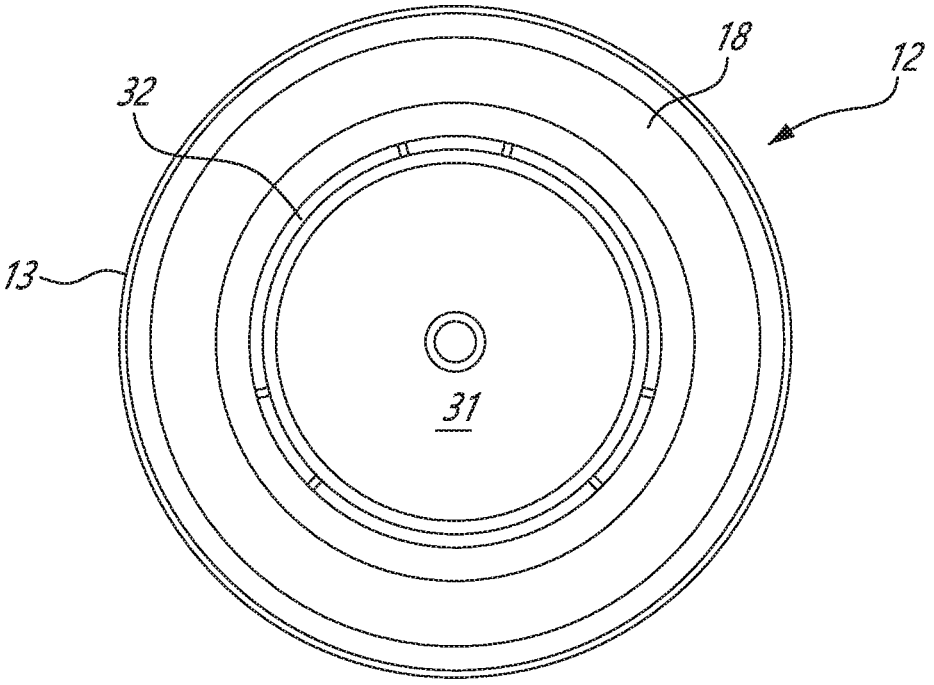
FIG. 4 is a bottom view of a cup embodiment of the present disclosure.
Figure 5:
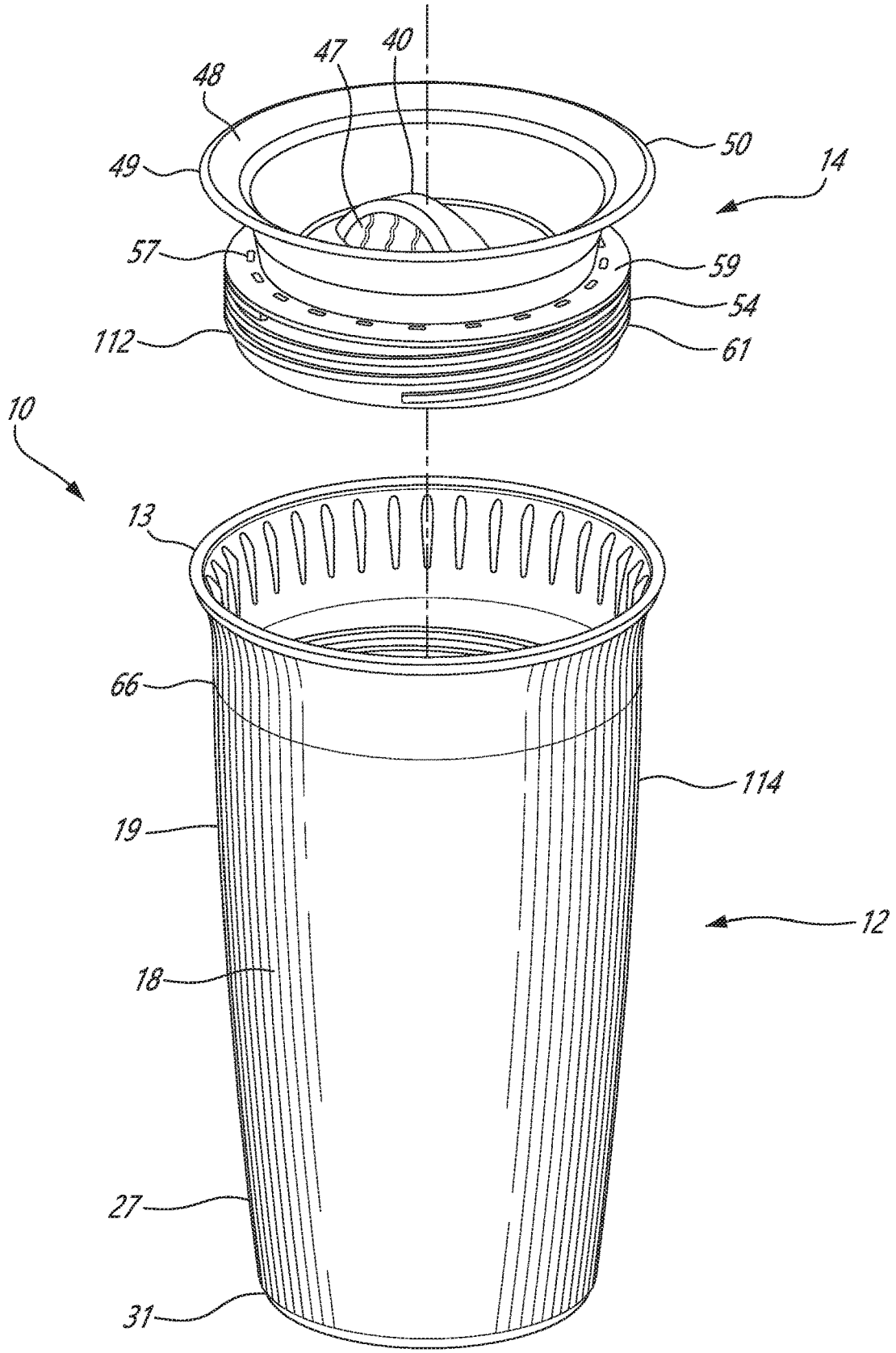
FIG. 5 is an angled top view of an unassembled cup assembly embodiment of the present disclosure.

As shown in FIG. 4, some embodiments of the cup 12 provide one or more feet 32 (or pedestal(s)) to reduce the contact area of the cup bottom 31 and the surface on which the cup 12 rests. This mitigates in the cup 12 sliding off a wet surface and facilitates drying of the cup bottom 31 when the cup is at rest and sitting upright on the one or more feet 32.

In some embodiments, the cup assembly 10 has one or more handles 30. The handles 30 are suitably sized for grasping by a child. Optionally, the handles are removable from the cup assembly 10. The one or more handles 30 are optionally connectable to the upper wall 19 and extend downward towards the cup bottom 31, or are connectable to the cup bottom 31 and extend upward towards the upper wall 19. The one or more handles 30 are spaced a suitable distance from the cup body 18 such that the child can grasp the one or more handles 30 and/or the child or caretaker can grasp the cup 12 between the one or more handles 30 and cup body 18. The one or more handles 30 are optionally attachable by a friction fit about the body 18 of the cup 12, and further optionally have alignment features 71. Alignment features 71 can include, for instance, male and female members such as one or more ribs and one or more mating recesses, a ledge or shoulder forming a seat to receive the handles 30, etc., located on the cup outer wall 114 and handles 30, or optionally on lid 14 and handles 30. In embodiments where the lid 14 is in the form of a collar, handles 30 can be integral with the collar or can be removably connectable to the lid 14 via friction fit or by alignment features 71. Other handle 30 embodiments are contemplated below.

In some embodiments, one or more handles 30 are elongate. These one or more handles 30 extend outward, upward, and/or downward about the exterior of the cup assembly 10. The handles 30 are optionally connectable to one or more utensils 68. Such utensils 68 include without limitation a spoon, fork, or spork. The utensil 68 has a handle portion 70 and a feeding portion 72. In some embodiments, the utensil 68 has a connection feature 74 on its handle portion 70. In other embodiments, the utensil 68 feeding portion 72 has a connection feature 74. In some embodiments, the utensil 68 is connectable to the handle 30 by two or more connecting means to ensure the handle 30 and the utensil 68 extending the length of the handle 30, are sturdy and won't unintentionally disassemble while the user is grasping the handle 30 (and utensil 68 therewith).

In some embodiments, the handle 30 forms a receiving portion 76 that is u-shaped with deflectable sides that act as living springs. To connect the utensil 68 to the handle 30, the user pushes the handle past the u-shaped receiving portion (thereby deflecting) to achieve a secured connection.

In further embodiments, the handle 30 has a male or female connector 76, where the utensil 68 has the mating female or male connector. Such connectors can be a hole and a peg, or protrusions 75 that fit amongst, for instance, the tines 73 of a fork or spork. Using a thermoplastic elastomeric material, silicone, or other softer/tacky material with a higher coefficient of friction than smoother plastic materials, can help facilitate a secure connection between the handle 30 and the utensil connecting feature 74.

In some embodiments, the u-shaped connection feature 76 in the handle 30 is blind, is concave, and/or is recessed into the handle 30. In the event of a blind connection feature 76, the connection feature 76 is easy to clean due to being properly sized. For example, the connection feature 76 is sized to permit a small brush, or is openable via a snap-fit, friction-fit, press-fit, latch, or other mechanical means as described in the present disclosure, such that the blind portion is opened for much simpler cleaning. In these embodiments, the utensil feeding portion 72 is inserted into the recessed portion thereby mitigating against exposure to dirt until it is removed for use as a utensil 68. In these embodiments (where the utensil feeding portion 74 is internal and substantially covered within the recess), the utensil handle portion 72 has a similar shape as the handle 30 such that the handle 30 and utensil handle portion 72 look as if it is meant to be a single component.

In embodiments wherein one or more utensils 68 are connectable to the handle 30, the utensil 68 is positioned such that its width is parallel to the periphery of the cup 12, and its depth is perpendicular to the periphery of the cup 12. In this configuration, the one or more handles 30 extended by the one or more utensils 68 (having a handle width 77 greater than the handle depth 79) permits sufficient space between the cup outer wall 114 and the utensil(s) 68 such that the cup 12 can be held about the cup outer wall 114 or the one or more handles 30 (including the utensil(s) 68). In some embodiments, the one or more utensils 68 that are positioned and connected to the one or more handles 30 such that the utensil handle portion 70 can be grasped by a child while drinking from cup assembly 10 similarly to how a child would grasp the one or more utensil handle 70 while eating.

The lid (or valve cap) 14 have a flexible valve on the lid's 14 upper outer periphery (or outer edge) 49 that is deflectable when a force is applied against it. Upon deflection (via the suction force or deflection/pressure applied by a user), the flexible valve 48 moves to create an opening 57 between the inner (or lower) surface 69 of the flexible valve 48 and the platform 17 of the cup 12. The flexible valve 48 deflects upwardly and away from the lip 13 and/or platform 17. The flexible valve 48 deflects by virtue of its interaction with spacers 26 or platform 17 walls between recesses 28. Spacers 26 (or platform 17 walls between recesses 28) act as a fulcrum creating an axis of deflection for the flexible valve 48. Where the spacers 26 are on the flexible valve lower surface 69, the axis of deflection is about the contact point between spacers 26 and platform 17. The flexible valve 48 is biased into a closed position such that, without the application of a force directed to the flexible valve 48, the flexible valve 48 remains substantially sealed against the platform 17 of the cup 12. In this fashion, the cup assembly 10 mitigates against spills when the cup assembly 10 is tipped such that the lid 14 is other than substantially parallel to the ground (or the surface on which the cup assembly 10 rests).

As exemplified in FIGS. 4-10, the lid 14 is connectable to the cup 12. The lid 14 has a lid height 42 of between about 10 mm and about 60 mm, or more preferably, between 20 mm to 40 mm. The lid 14 has a lid diameter 44 of between about 40 mm and about 120 mm, or more preferably between 60 mm to 90 mm. The lid 14 includes a first portion or upper portion 50. The first portion 50 includes the flexible valve 48 and generally permits sealing of the cup assembly 10 such that fluid does not escape out of the cup assembly 10 in the absence of a user-applied force. The lid 14 includes a second portion or lower portion 54.

Figure 6:
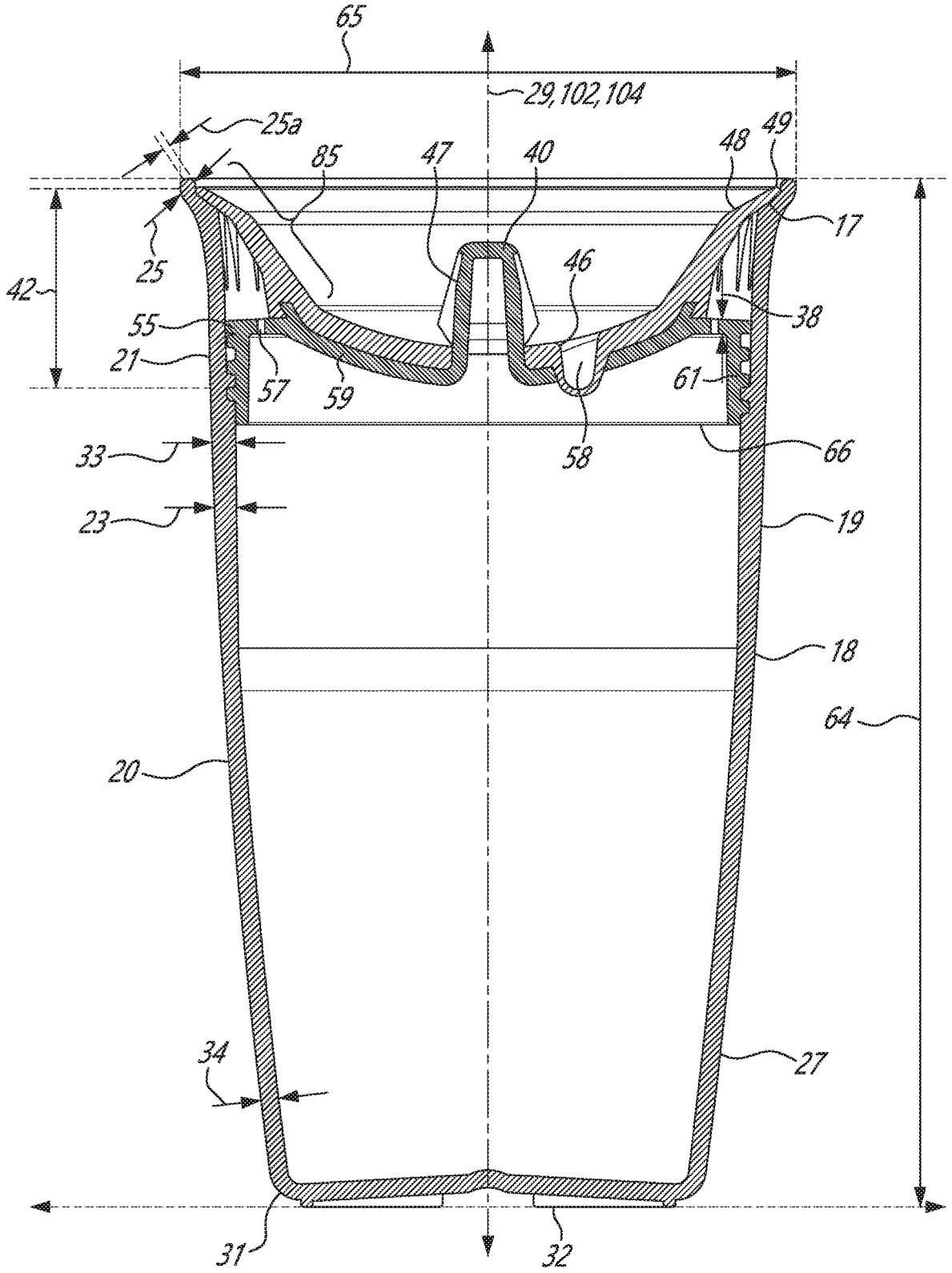
FIG. 6 is cross-sectional view of a cup assembly embodiment of the present disclosure.
Figure 7:
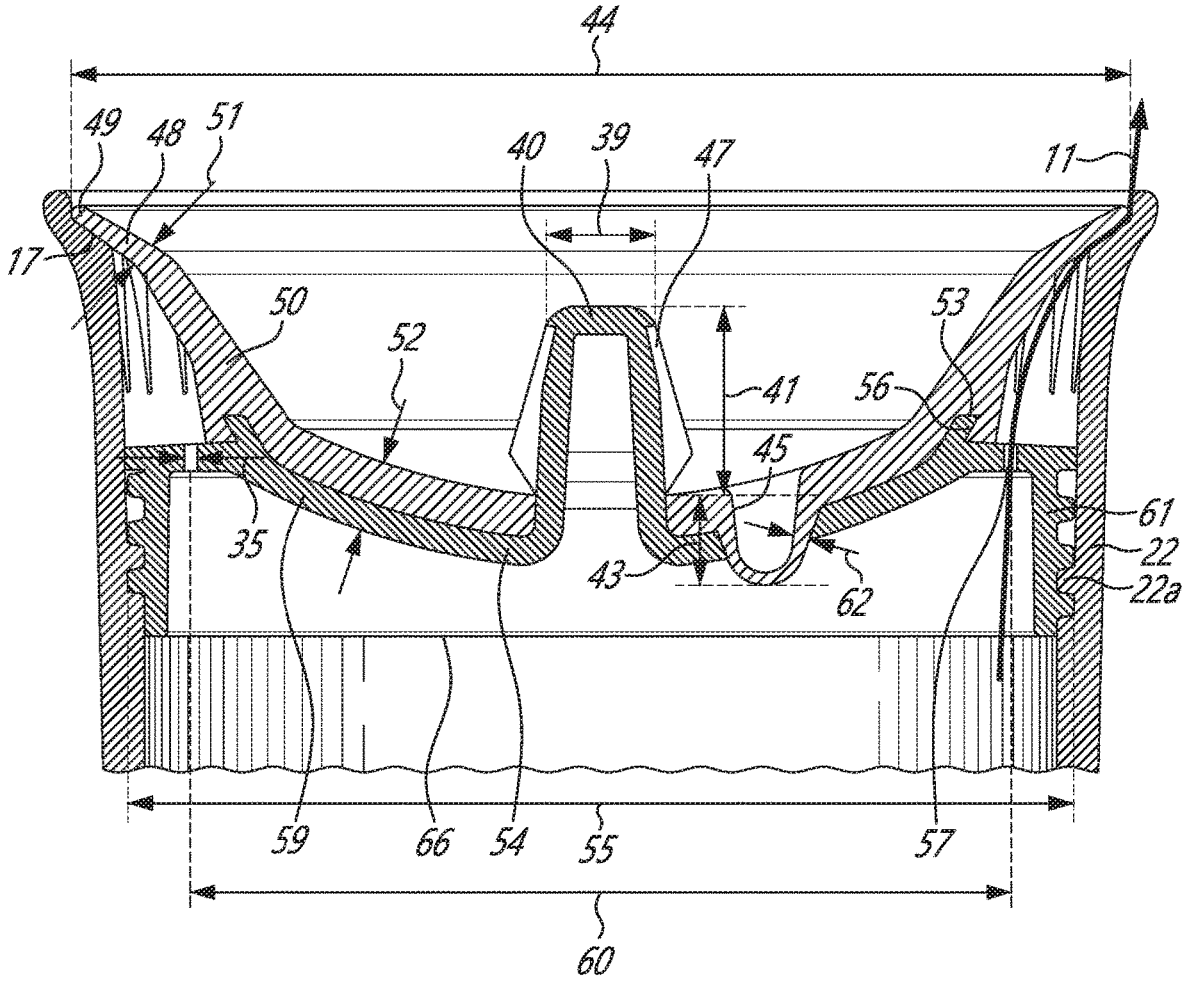
FIG. 7 is a detailed view of FIG. 6.
Figure 8:
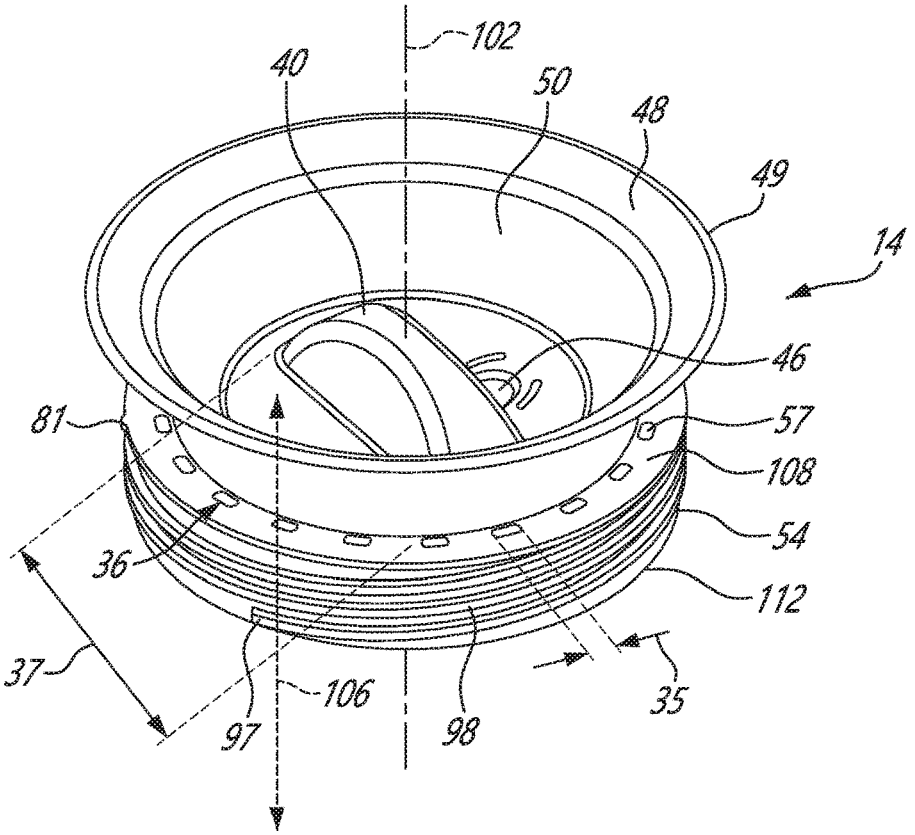
FIG. 8 is an angled top view of a lid embodiment of the present disclosure.
Figure 9:
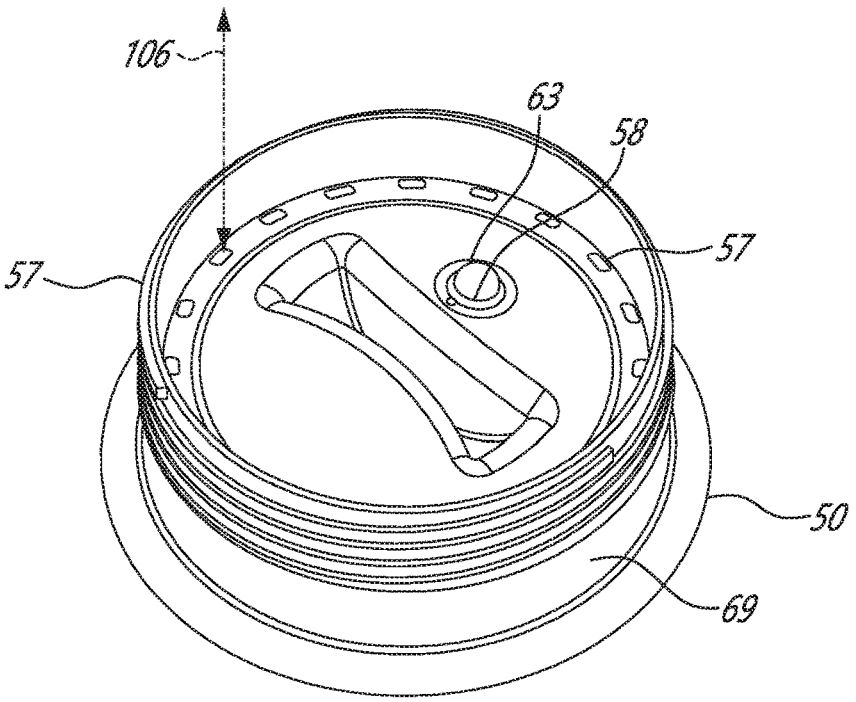
FIG. 9 is an angled bottom view of a lid embodiment of the present disclosure.

The first portion 50 and second portion 54 are configured to be a unitary piece connecting at center portion 60. In some embodiments, the lid 14 including the first portion 50 and second portion 50 are a single material, such as a thermoplastic material having a durometer of between about 30 and about 70. In other embodiments, the first portion 50 is a first material and the second portion 54 is a second material. In some of these embodiments, the first portion 50 and the second portion 54 can be attached to each other by mechanical means, such as by connecting means 53 (on first portion 50) and connecting means 56 (on second portion 54). Although FIGS. 6-7 show connecting means 53 as a recess and connecting means 56 as a protrusion, these could be opposite. Further, either of connecting means 53 or connecting means 56 could be one or more through holes having a taper or a step with the other having one or more mating projections facilitating first portion 50 and second portion 54 to be co-molded or otherwise assembled together to form a unitary structure. First portion 50 and second portion 54 can also be attached via chemical means such as adhesives, and/or other means such as welding, ultrasonic welding. In other of these embodiments, the first portion 50 and the second portion 54 are co-molded or over-molded, such as by a two-shot injection molding process. In some embodiments, lower portion 54 is substantially flat and user grip feature knob (or handle) 40 is entirely upper portion 50.

In any event, the lid 14 is designed to be easy to clean to avoid harboring dirt or other soilings. For example, upper portion 50 and lower portion 54 are sealed to mitigate against foreign matter entering-into connecting portion 60. In one aspect of the present disclosure, the upper portion 50 and the lower portion 54 include a clearance 87 between the lower surface 69 of the flexible valve 48 and the one or more openings 57 in the top surface 108 of lower portion (or second portion, or baffle) 54. The clearance 87 extends along an opening vertical axis 106 that is substantially parallel to the lid vertical axis 102, where the opening vertical axis 106 is position about the innermost location of the opening 57. The clearance 87 defines a clearance height between the top surface 108 of lower portion 54 and the lower surface 69 of flexible 48 along the opening vertical axis 106. The clearance height 88 is at least 0.125 inches (3 mm) such that water and cleaning instruments such as a small brush are able to access this portion of the lid 14. Preferably, clearance height is at least about 0.25 inches (6 mm). The clearance height 88 is less than or equal to about 1 inch (2.54 cm).

In embodiments having multiple surfaces (stepped, frusto-conical, tapered, and/or combinations thereof) defining the top surface 108, the clearance 87 is defined from the portion of the top surface 108 that includes the hole 57 being measured, and as such, projection 90 of the clearance opening may be other than parallel to the opening vertical axis 106; the same holds true of projection 90 in embodiments with obstructions 101. In instances where multiple surfaces include multiple holes that are located at different radial locations on the top surface 108, the clearance 87 is so defined with respect to any hole 57, but is most critical for hole(s) 57 most proximal to center portion 60.

The clearance length 89 is defined as the distance between the opening vertical axis 106 and the lower outer periphery 55. The clearance length 89 enables sufficient access to reach and clean the clearance 87 portion of the lid 14. Where a hole 57 is in an angled top surface 108, the clearance length 89 is defined as a projection of a top surface plane 110 from the hole vertical axis 106 and extends to the outer periphery of where the angled top surface ends 108. For example, if the angled top surface 108 changes slope into a stepped surface, the clearance length 89 would be along the top surface plane 110 from the hole vertical axis 106 to where the angled top surface 108 ends and the stepped surface begins. The clearance length 89 is at least 0.125 inches (3 mm), and more preferably, at least about 0.25 inches (6 mm). The clearance length 89 is less than or equal to about 1 inch (2.54 cm).

The clearance opening 91 is defined by a vertical projection 90 between the lower outer periphery 55 that is substantially parallel to the opening vertical axis. The vertical projection 90 runs between the top surface 108 of the outer periphery 55 of lower portion (or second portion, or baffle) 54 to the lower surface 69 of flexible valve 48. In some embodiments, vertical projection 90 runs from the outer periphery 55 of lower portion 54 and the outer edge 49 of upper portion 50. The clearance opening 91 is at least 0.25 inches (6 mm), and more preferably, at least 0.375 inches (920 mm), and most preferably, at least about 0.5 inches (12 mm). The clearance opening 91 is less than or equal to about 1 inch (2.54 cm).

In embodiments where a surface or wall encroaches on the clearance opening 91, the clearance opening 91 as calculated above would be reduced by the length of the encroaching feature. In situations where the encroaching feature causing an obstruction 101 is flexible and can be deflected away to easily clean the blocked area, the length of deflection would be included to define a modified clearance opening 92. Modified clearance opening 92 would be subject to the same size restrictions as clearance opening 91. While obstructions 101 have been discussed with respect to clearance opening 91, the same principals would hold true for clearance height 88 and clearance length 89.

In some embodiments, the clearance length 89, the clearance height 88, and the clearance opening 91 are small (but exceed the minimums outlined in the present disclosure) such that the clearance is easy to clean but not excessively narrow or deep. Due to constraints with configuring the knob (or handle) 40, the center portion 60, the goal of directing fluid towards the lip 13, controlling the flow rate of the liquid out of the cup assembly 10, and making the lid 14 suitably discrete from a side elevation view, it is desirous to have a clearance cross-sectional area 95 of between about 0.010 square inches (0.06 square centimeters) to about 0.75 square inches (4.8 square centimeters). The clearance cross-sectional area 95 is defined by the bounds of the clearance height 88, clearance length 89, clearance opening 91, and any obstructions 101. A modified clearance cross-sectional area 103 and modified clearance angle 109 would account for deflection of any obstructions 101.

The geometry of the lid upper surface 85, from the outer periphery 49 to the center portion 60, is generally flat, downwardly tapered, downwardly stepped, downwardly frusto-conical, slightly recessed, or concave shape, where the center portion 60 (having knob or handle 40) can be upwardly tapered, upwardly stepped, upwardly frusto-conical, slightly bulbous or convex shape, but the lid upper surface 85 (aside from the outer periphery 49) is not visible from a side elevation view of the cup assembly 10.

The center portion 60 of lid 14 generally designates the connection point between the upper portion 50 and lower portion 54 of the lid 14. Center portion 60 has a connecting height 93 defined as the connecting wall surface (and related distance) between the top surface 108 of lower portion 54 and the lower surface 69 of upper portion 54. It is preferable to have a generally planar center portion 60 with a sufficient connecting height 93 to improve cleanability by avoiding crevices. Connecting height 93 is at least about 0.125 inches, and more preferably, at least about 0.25 inches. Connecting height 93 is less than about 0.75 inches, and more preferably, less than about 0.5 inches.

While the dimensions and access to connecting height 93 has been described in detail, the teachings with respect to the clearance height 88, clearance length 89, projection 90, clearance opening 91, modified clearance opening 92, clearance cross-sectional area 95, and modified clearance cross-sectional area 103, apply to connecting portion 60, as does the clearance angle 94 described in greater detail below. For example, FIGS. 15-17*a* describe the modified connecting angle 107, the connecting length 111, and connecting cross-sectional area 115.

A clearance angle 94 is defined as the angle between the intersection of a projection of the top surface plane 110 and the projection of the lower surface 69 of the flexible valve 48. Preferably, the clearance angle 94 is at least about 10 degrees, is at least about 15 degrees, at least about 30 degrees, and more preferably greater than about 45 degrees. The clearance angle 94 is less typically less than about 90 degrees due to the geometry of the lid 14, but it is clear to one skilled in the art that a clearance angle 94 greater than 90 degrees would likely be advantageous as it is likely that affords greater accessibility.

In some embodiments, clearance angle 94 is about the same or equal to connecting portion angle 105, particularly where top surface 108 is entirely coplanar and not stepped. The first portion 50 has varying wall thickness such that the outer edge thickness 51 of the flexible valve 48 is thin in comparison to an inner region thickness 52. The outer edge thickness 51 is between about 1 mm and about 4 mm, or between about 1.0 mm to about 2.0 mm. The outer edge 49 has a geometry that is not completely complimentary to the geometry of the lip 13 and/or platform 17 in order to assist the child who is applying a force to the flexible valve 48 to withdraw fluid from the cup. In other words, if the geometry of the outer edge 49 was perfectly complementary to the geometry of the lip 13 and/or the platform 17, it would be possible for a force to be created between these components (particularly where there is moisture creating surface tension), thereby making it difficult for the child to withdraw fluid from the cup as exemplified in FIG. 7. The outer edge 49 has a sleek sealing edge geometry (but one that will not cause injury to the user) or a rounded (or arcuate) sealing edge geometry.

The second portion 54 has a baffle 59 including one or more openings 57 that control fluid flow from the cup 12 volume through and to the flexible valve 48. In the embodiments shown in FIGS. 5-6, the outer edge 49 has a greater width than the outer edge 55 of the second portion 54. The one or more openings 57 are radially inward of the outer edge 55 of second portion 54 such that the openings 57 do not interfere with the cup connecting means 61. In some embodiments like those shown in FIGS. 5, 8, and 9, there are at least two openings 57, at least five openings 57, at least 10 openings 57, and optionally at least 12 openings 57. In some embodiments, the one or more openings 57 are up to about 100, up to about 80, up to about 60, up to about 40, or up to about 20. In some embodiments, there are between about 1 and 30 openings 57, or between about 14 and 26 openings. In some embodiments, the one or more openings 57 are at a series of heights or at different radial widths about the lid, or have different geometries/sizes. Each of the one or more openings 57 has a length 35 between about 1 mm and about 10 mm, or between about 2 mm and about 6 mm. Each of the one or more openings 57 has a width 36 between about 1 mm and about 10 mm, or between about 1 mm and about 3 mm. Each of the one or more openings 57 has a depth 38 between about 1 mm and about 10 mm, or between about 2 mm and about 6 mm. In some embodiments, the surface area of the one or more openings 57 is between about 2 mm2 and 620 mm2, or between about 100 mm2 and about 350 mm2, or between about 100 mm2 and about 250 mm2, where the one or more openings 57 and/or the area is distributed generally evenly around (but inward of so as to not interfere with the cup connecting means 61) the perimeter or outer edge 55 of the baffle 59 (or the second portion 54), or optionally, the surface area is generally distributed so that any given radial section including at least one opening 57 would be similar to any other given radial section including at least one opening 57. Such generally even distribution of surface area around the baffle 59 ensures a generally even amount of flow no matter what region of the flexible valve 48 is activated. The baffle 59 can be a generally rigid material such as a hard plastic. As discussed below and as exemplified in FIG. 10, baffle 59 can be a generally flexible material that enables deflection.

As shown in FIGS. 6-9, the one or more openings 57 are positioned radially outward of the center portion 60. In some embodiments, the one or more openings 57 are not impeded by the cup connecting means 61, In some embodiments, the one or more openings 57 are not immediately adjacent flexible valve 48. In some embodiments, the one or more openings 57 are distal from channels 24.

Figure 10:
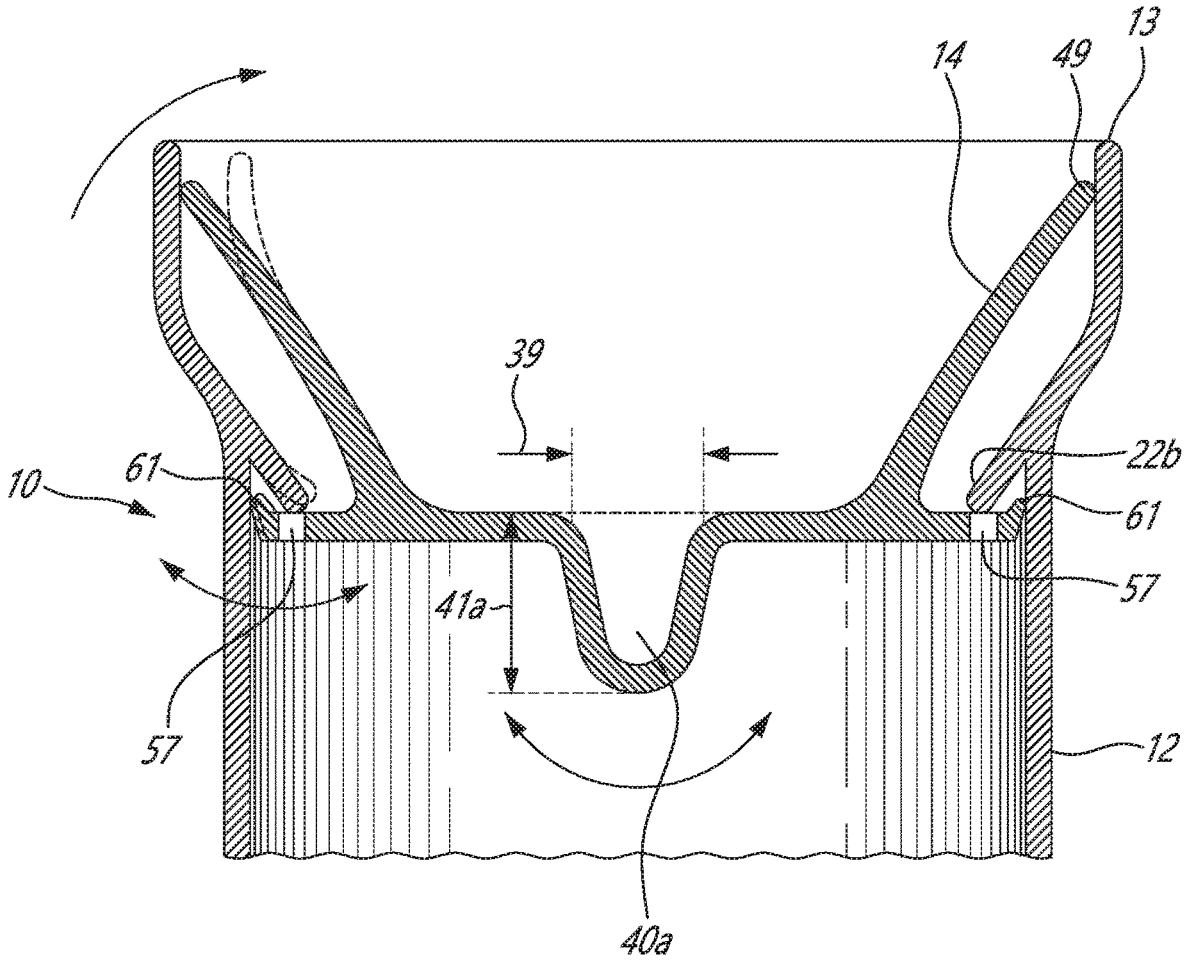
FIG. 10 is a detail sectional view of a cup assembly embodiment of the present disclosure.
Figure 11:
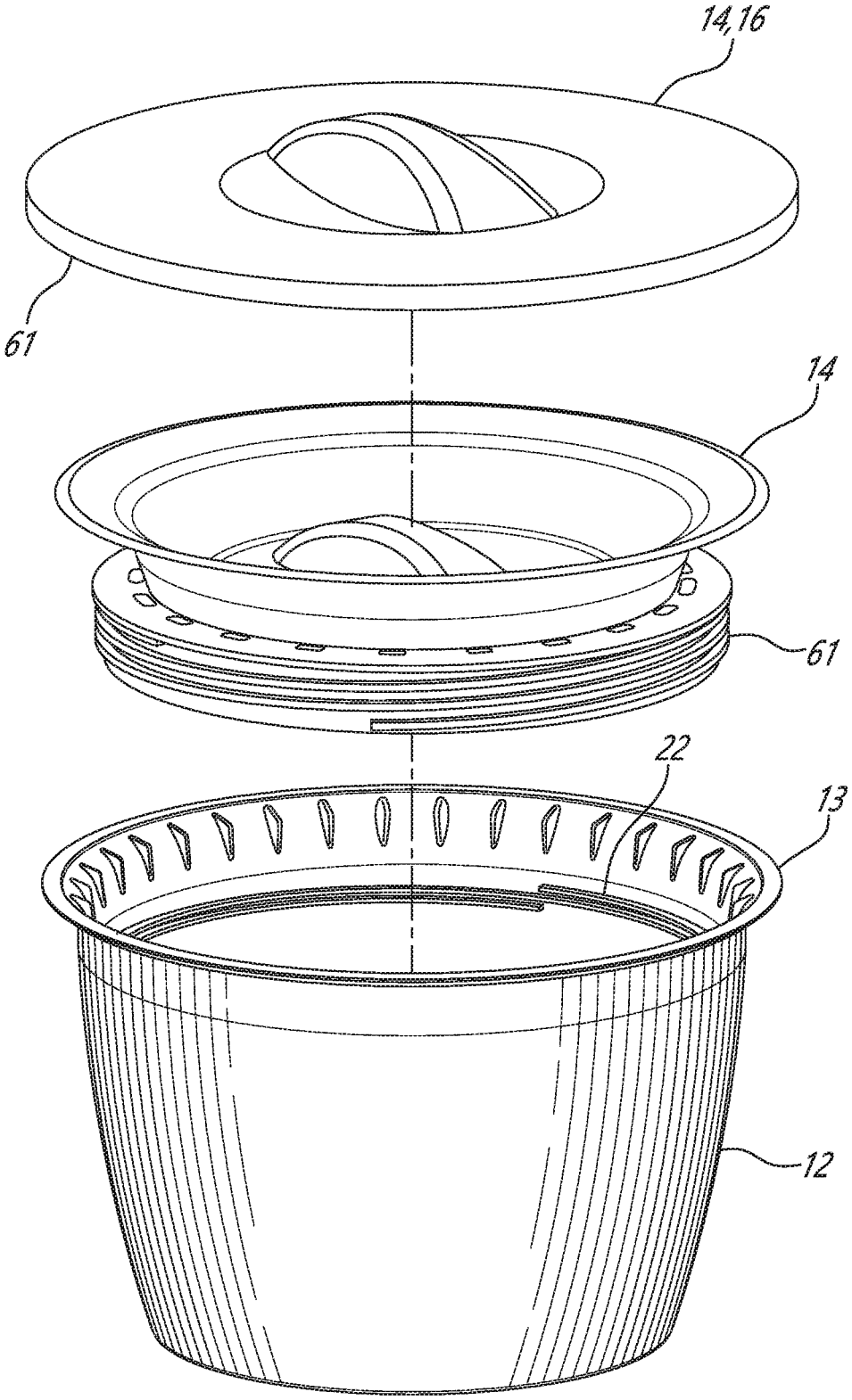
FIG. 11 is an unassembled cup or container assembly embodiment of the present disclosure.
Figure 12:
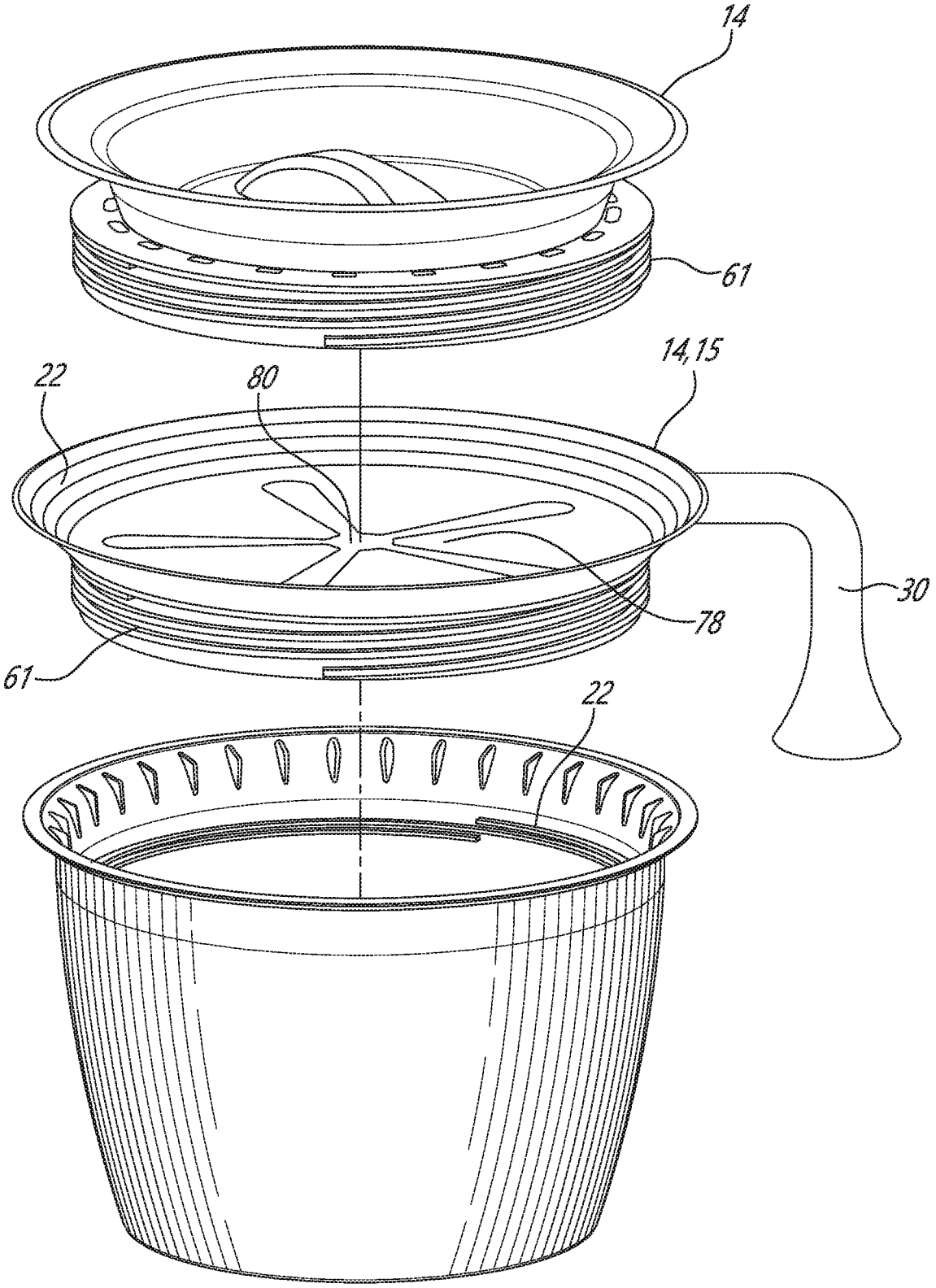
FIG. 12 is an unassembled cup or container assembly embodiment of the present disclosure.
Figure 13:
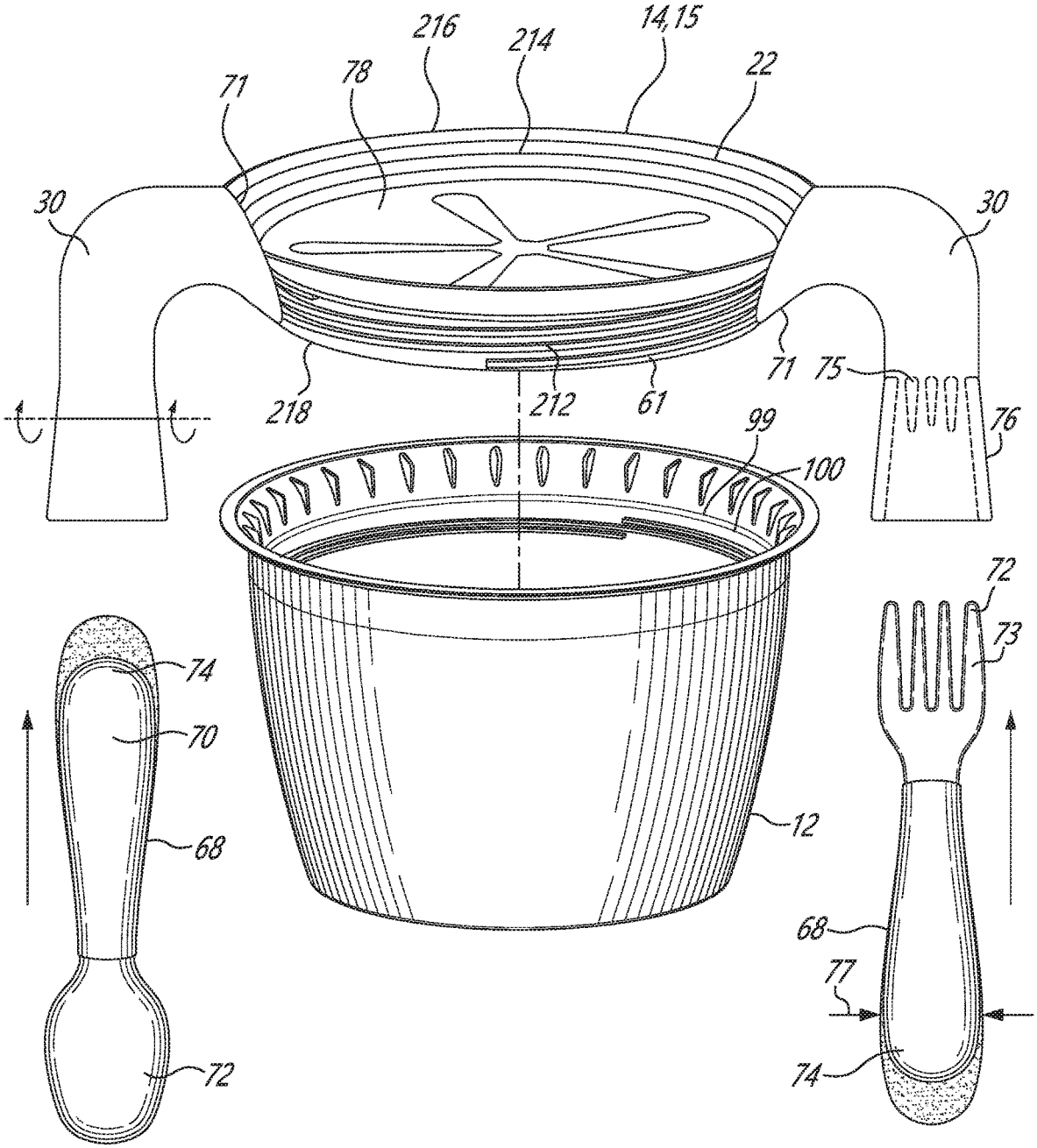
FIG. 13 is an unassembled cup or container assembly embodiment of the present disclosure.
Figure 14:
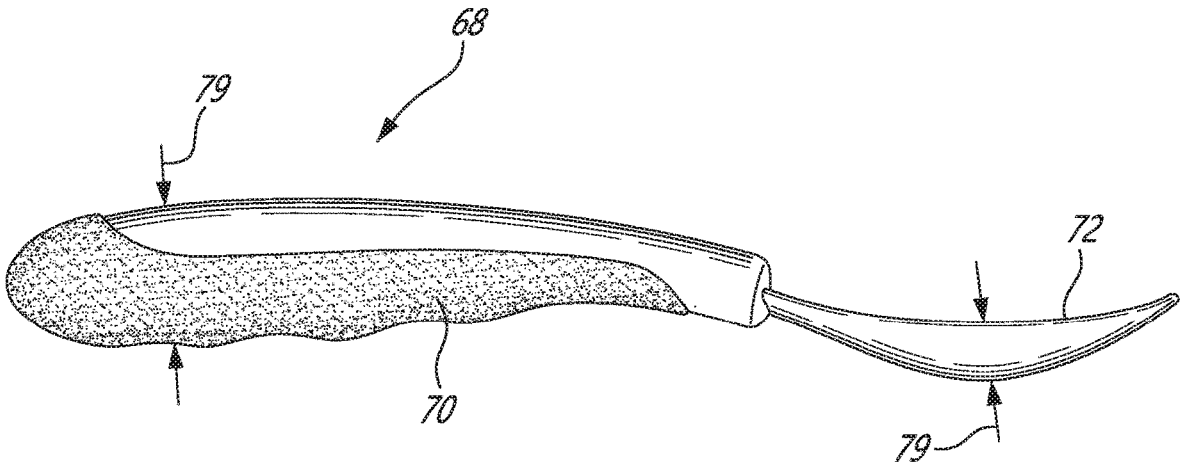
FIG. 14 is a view of a utensil as shown in FIG. 13, as it relates to an embodiment of the present disclosure.
Figure 15:
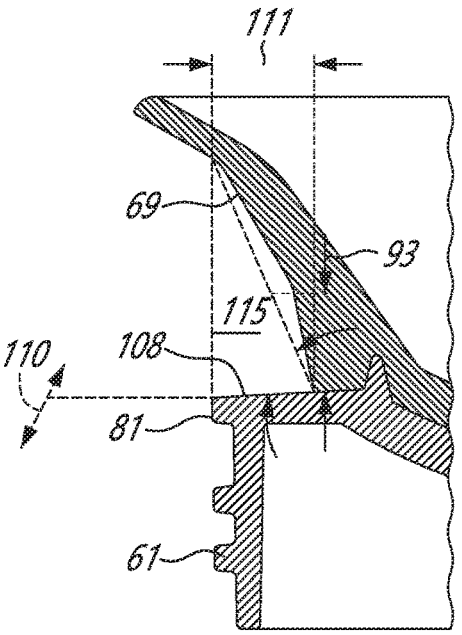
FIGS. 15, 15*a*, 16, 17, and 17*a* show schematic representations of lid embodiments of the present disclosure.
Figure 15A:
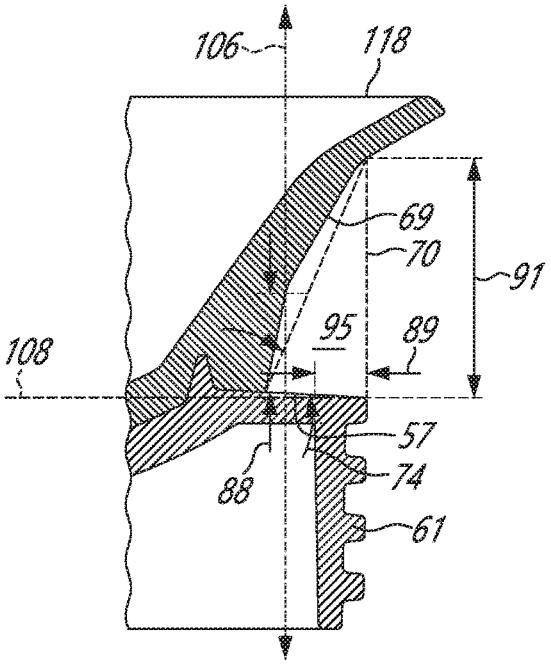
Figure 16:
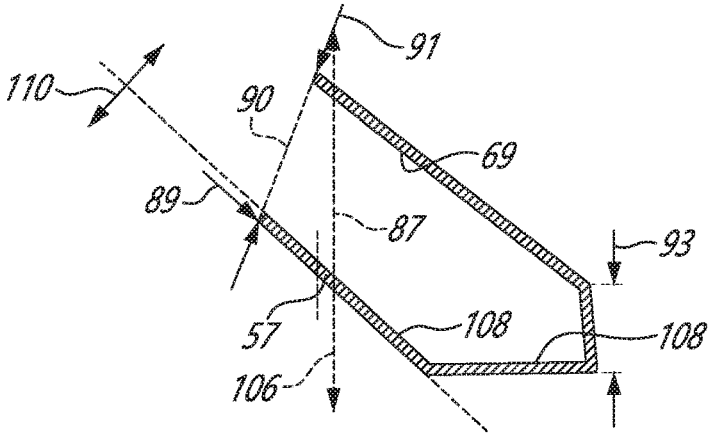
Figure 17:
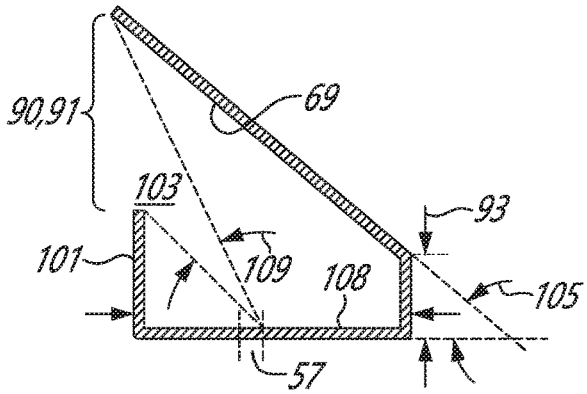
Figure 17A:
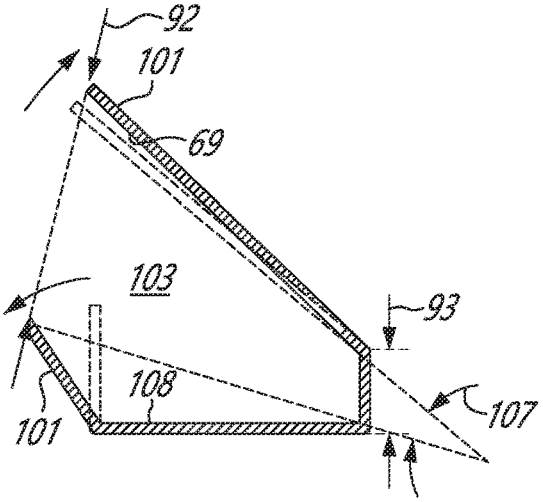

As exemplified in FIG. 10, the cup assembly 10 includes a unitary lid 14. The baffle 59 is a flexible material that deflects upon application of a force to flexible valve 48. In a connected and sealed rest position, baffle 59 has one or more openings 57 positioned under a lid connecting means 22 in the form of lip 22*b*. Upon application of a force by a child, the flexible valve 48 deflects from platform 17. The deflection (as exemplified by the arrows on FIG. 10) of flexible valve causes baffle 59 to shift, such as by retracting, and/or elastically stretch causing the one or more openings 57 to come out of alignment from lip 22*b*, thereby permitting fluid to flow (as shown by arrow 11 on FIG. 7) from the cup volume, through one or more openings 57, and out of the space between the cup 12 lip 13 and platform 17, and the lid 14 flexible valve 48. When the force is released, the flexible valve 48 returns to its rest position and causes the baffle 59 to reposition itself such that the one or more openings 57 align with lip 22*b* closing off fluid flow. In this embodiment, two points of closure are achieved—the first between the flexible member 48 and platform 17 (and optionally lip 13), and the second between baffle 59 and lip 22*b* (by virtue of the one or more openings 57 being aligned with and thus covered by lip 22*b*).

Embodiments similar to the embodiment shown in FIG. 10 have a cup assembly 10 where the lid 14 is connected to the cup 12 by a snap-fit, friction-fit, or press-fit. To fully-assemble the cup assembly 10, the user applies downward pressure to, at minimum, opposite sides of the lid 14 such that the lid 14 remains parallel to the cup bottom 31 during the assembly process. The outer edge 55 of the baffle 59 portion of the lid 14 is flexible enough to flex past lip 22*b* and create a sealed connection with cup 12. The user is able to determine when a connection is achieved by one or more of the following: visual alignment of flexible valve 48 and the upper geometry of the cup 12 (being proximal lip 13 and/or covering platform 17), the audible and/or tactile sensation caused by the press-fit and/or snap-fit, and the equal-and-opposite force felt when the lid 14 cannot be pushed further downward into cup 12. In these embodiments, the lid 14 can be removed from the cup 12 by pressing one side of the lid 12 downward, causing the opposite side of the lid 14 to deflect upward (via the outer edge 55 of the baffle 59 deflecting and thereby passing over the lip 22*b*). The user can then grasp the opposite side that is elevated with respect to lip 22*b* and remove the lid 14 from the cup 12.

In the embodiments exemplified by FIG. 10, the cup includes lip 22*b* and optionally additional retention features similar in structure to lip 22*b* below and parallel to lip 22*b* (to form a sandwich connection by which outer edge 55 of lid 14 is retained there between). To mold such a cup, an undercut would be required, thereby adding manufacturing complexity and cost. As such, lip 22*b* and other similar retention features can be angled such that they are not perpendicular to the lid vertical axis 102, thereby having a slight taper and being similar to one or more threads. Such a design would enable manufacturing with a mold having rotatable core, similar to those that are used to mold threads into many of the other embodiments of the present disclosure. In such embodiments, outer edge 55 can likewise be angled with respect to lid vertical axis 102 such that it has a slight taper, and can thusly be rotated into cup 12 for connection as opposed to a press-fit, snap-fit, friction-fit, and/or detent connection.

In the embodiments exemplified by FIG. 10, assembly and disassembly are assisted by the inclusion of a handle or knob 40 as discussed below. Alternatively, in lieu of a handle or knob, a slot is provided such that a user can place a couple fingers into the slot to apply a rotative force thereby causing outer edge 55 of baffle 59 to deflect and pass over lip 22*b* whereby the lid can be removed from the cup 12. In such embodiments, slot 40*a* has similar length 37 and depth 41*a* dimensions as handle or knob 40 as described below, where slot depth 41*a* is similar to knob height 41. The width of slot would be at least about 0.5 inches and up to about 1 inch. In some embodiments, the lid 14 is made from a flexible material thereby enabling easier deflection of the lid to assist in removal of the lid 14 from the cup 12.

Embodiments having a one-piece lid 14 can be made from a single material with varying thickness (to accommodate portions that need to flex while other portions need to be substantially rigid). Optionally, the lid 14 can be made from a substantially rigid plastic material as discussed in the present disclosure forming a core, with a flexible material over molded onto the core thereby forming the lower outer periphery 55 and the flexible valve 48. The core includes portions of baffle 59, as well as being located in the center portion 60. The over molded lid 14 can be a two-shot process. Further, lid 14 preferably does not have any undercuts, thereby simplifying manufacturing and reducing costs.

The lid 14 has an air vent 58. The air vent 58, as exemplified in FIGS. 6-7, has a tapered geometry and a depth (or height) 43 with a lead-in 46, and is of suitable size (such as air vent area 45) to enable cleaning (via water spray or a small brush). The wall thickness 62 proximal the air opening 63 cracks to alleviate excess pressure and prevent a vacuum force within the cup 12 volume that would prevent a child from withdrawing fluid from the cup assembly 10. The air vent 58 is, for example, a slit-valve, an x-valve, duckbill valve, or other known vent by those skilled in the art. As exemplified in FIGS. 6-7, the vent has a wall thickness 62 that is tapered. Other embodiments employ a uniform wall thickness 62. As shown in the figures, the air vent 58 is located eccentrically with respect to the lid vertical axis 102, however, the air vent 58 can be positioned in the center portion 60 and/or through the central vertical axis 29 of the cup. While the figures show a single air vent 58, multiple air vents 58 suitably sized/arranged to activate upon an appropriate level of force are within the scope of the present disclosure.

Air vent 58 air opening 63 impacts the rotational force (torque) required to remove the lid 14 from cup 12. An air opening of about 3 mm corresponds to about 11 in-lb of torque, while an air opening of about 4.5 mm corresponds to about 6 in-lb of torque. Accordingly, it is desirable to have a vent torque ratio defined as the removal torque divided by the length of the air opening 63 of between about 1.25 to about 5. Where the air opening is curved, the length of the air opening 63 a projection (or the secant line) between the ends of the slit and not the curved length of the air opening surface.

A handle or knob 40 is provided, as exemplified in FIGS. 4-9. The handle or knob has a width 39, and a height 41 of between about 6 mm and about 40 mm, or between about 10 mm and about 20 mm. The handle or knob 40 is sized to be grasped by a user to connect or disconnect the lid 14 from the cup 12. The handle or knob 40 is generally positioned in the center portion 60 of the lid 12. The handle or knob protrudes upward from the first portion 50. In some embodiments, the handle or knob 40 is part of the second portion 54. In some embodiments, the handle or knob 40 is part of both the first portion 50 and the second portion 54, such that the first portion 50 is overmolded or co-molded onto the second portion 54. In such embodiments, the handle or knob 40 facilitate connecting the first portion 50 and second portion 54 to create a unitary lid 12.

The handle or knob 40 has a height 41, length 37, and width 39, which are sized such that handle or knob 40 does not interfere with a child while drinking from the cup assembly 10. The handle or knob 40 length 37 is between about 12 mm and about 60 mm, or between about 20 mm and about 40 mm. The handle or knob 40 width 39 is between about 1.5 mm to about 20 mm, or between about 3 mm to about 12 mm. When the cup assembly 10 is fully-assembled and lid 14 is secured to the cup 12 in a sealed configuration, the handle or knob 40 has a height 41 that does not exceed the cup height 64 (cup bottom 31 to lip 13) such that from a side elevation view, the cup assembly 10 looks like an ordinary cup. The handle or knob 40 has gripping structures 47 such as ribs, protrusions, or recesses.

In some embodiments, cup assembly 10, including the cup 12 and lid 14, are thermoplastic materials such as plastics, polypropylene, polyethylene, polyester, kostrate, silicone, TPE, rubber, latex, or other thermoplastic materials. The cup or container assembly 10 is made from a variety of materials, including without limitation: sealed wood, metal, composite materials, woven fiber materials, metals such as stainless steel, copper, aluminum, nickel, reconstituted or recycled materials, and/or bio-based materials such as sugarcane, blends of bio-based materials with plastic materials such as polypropylene, or any combination thereof. Preferably, the cup or container assembly 10 is made from material that provides sufficient rigidity in order to give it structure while providing sufficient flexibility so it can deflect under the user's hand or mouth to facilitate one or more user activated input features. Furthermore, the cup or container assembly 10 is sufficiently durable to repeated usage, cleaning, storage and optionally connection to other items. In embodiments having glass, a thermoplastic sleeve (that is attachable to or over-molded onto the glass) is advantageous to mitigate cracks upon dropping. In particular, the flexible valve 48 and/or the baffle 59 are made of a flexible material such as silicone, TPE, rubber, latex, or other thermoplastic materials. Such flexible materials allow for connection and separation of the flexible valve 48 from the lip 13 by deformation of the flexible valve 48 from the lip 13 and platform 17.

In some embodiments, the cup assembly 10 includes injection molded parts. In some embodiments, the cup (or container) 12 is injection molded. Where the cup (or container) 12 includes lid connecting means 22 having bayonet and/or threaded connections, a threaded core cavity is used that is rotated outward from the cup (or container) 12 as if lid 14 were being disconnected from the cup (or container) 12. In other words, the threaded core cavity and cup (or container) 12 undergo relative rotational movement with respect to each other in order to release the cup (or container) 12 from the mold (including the threaded core cavity).

In some embodiments, the lid 14 is connectable to the cup 12 by a cup connecting means 61 that engage lid connecting means 22 on the cup 12. The cup connecting means 61 and lid connecting means 22 matingly engage by a friction fit, interference fit, detent, bayonet connecting means, or threads, or hybrids thereof, or other connecting means as described by the present disclosure.

As shown in FIGS. 2, 6-9, and 11-13, lid connecting means 22 include one or more external threads located on the lid outer wall 112, and more specifically, the outer periphery 55 of lower portion 54. The lid connecting means 22 are located below the lip 13 when the lid 14 is fully connected to the cup (or container) 12. The lid connecting means 22 is likewise located below platform 17 when the lid 14 is fully connected to the cup (or container) 12. The lid connecting means 22 has one or more threads **22*a* with each of the one or more threads having a leading end 97 and one or more thread stops 84. The one or more thread stops 84 each have a thread stop vertical axis. Each of the thread stop vertical axes is substantially parallel to the lid vertical axis 102. Each of the one or more recesses 82 has a recess vertical axis. Each of the one or more recess vertical axes is substantially parallel to the lid vertical axis 102. The thread stop vertical axis and recess vertical axis are substantially parallel. The cup connecting means 61 include one or more internal threads located on the cup body 18, or more specifically, the cup inner wall 113. The cup connecting means 61 has one or more threads with each of the one or more threads having a leading end 97 and at trailing end 98. The cup connecting means 61 and lid connecting means 22 engage each other by relative rotational movement of one with respect to the other, such that the leading end(s) 97 engage each other until the one or more leading ends 97 on the cup connecting means 61 engage the one or more thread stops 84 on the lid connecting means 22**.

Proximal the lid connecting means 22 are one or more recesses 82. The one or more recesses 82 coincide with one more thread stops 84. The one or more recesses are offset from the one or more thread stops by a peripheral distance 86. In some embodiments, there are between two and five continuous threads, or there are between two and five threads broken into one or more thread segments. The peripheral distance 86 is at least about 0.25 inches (6 mm) and up to about 1.5 inches from the one or more thread stops 84. The peripheral distance is at least about 0.5 inches, at least 1 inch, or up to about 1.25 inches. The one or more recesses each have a lead-in 83 that terminates in each of the one or more recesses 82. The peripheral distance 86 is at least about 0.25 inches (6 mm) and up to about 1.5 inches from the one or more trailing ends 98. Proximal the cup connecting means 61 are one or more protrusions 81 such as a detent or tab, or tab having a detent. The one or more protrusions 81 have a length, width, and/or depth of (extending radially outward (or inward) from central vertical axis 29) of about 1/32 (0.75 mm) of an inch to about 1/8 (3 mm) of an inch, and more preferably between about 1/32 and about 1/16 (1.5 mm) of an inch. The one or more recesses 82 are dimensioned to be slightly larger than the protrusions 81, and as such, the length, width and depth dimensions are about the same or slightly greater (up to about 1/4 of an inch (6 mm)), albeit a lead-in could be provided to increase the bounds. The one or more protrusions 81 can be larger and likewise the one or more recesses can be as well, but the torque required to assembly and disassemble cup assembly 10 would increase as would the thickness of the cup. As such, it is preferable to keep the dimensions of the one or more protrusions 81 less than or equal to 0.5 inches. The one or more protrusions are offset from the one or more trailing ends 98 of the one or more threads by a peripheral distance 96. The peripheral distance 96 is at least about 0.25 inches (6 mm) and up to about 1.5 inches from the one or more trailing ends 98.

In some embodiments, the one or more recesses are above the lid connecting means 22, as described below. In some embodiments, the one or more protrusions 81 extend outward and/or downward from the lower portion 54 outer periphery 55 such that the one or more protrusions 81 extend outward of the cup connecting means 61. Upon relative rotational movement between the lid 14 and the cup 12 thereby causing connection of the lid 14 to the cup 12 via the cup connecting means 22 and the lid connecting means 61, respectively, the one or more leading ends 97 of the cup connecting means engage the one or more thread stops 84 just after the one or more protrusions 81 engage the one or more recesses 82 such that the one or more protrusions 81 resides within the one or more recesses 82. The one or more recesses 82 have a size (length, width, depth) that is larger than the one or more protrusions 81 such that the one or more protrusions 81 are fully-received within the one or more recesses 82. Upon such a complete connection, the one or more protrusions 81 ride over the cup inner wall 113 exerting pressure against the cup inner wall 113. When the one or more protrusions 81 engage the one or more recesses, the pressure is released creating a tactile and/or audible signal to the user that the cup assembly 10 is fully-assembled and the lid 14 is sufficiently connected to the cup 12 to mitigate against leaks. In some embodiments, the cup body 18 has a taper such that upper wall 19 proximal the lip 13 has a wider perimeter than the connection wall 21. As such, it is preferable to have the one or more recesses 82 positioned in the connection wall 21 above the lid connecting means 22 to accommodate the one or more protrusions having a greater perimeter than the cup connecting means 61.

Alternatively, the one or more recesses 82 and the one or more protrusions 81 can be positioned below the lid connecting means 22 and cup connecting means 61. While potentially less preferred due to tooling costs and perhaps due to wear on the parts, it is possible. Alternatively, the one or more recesses 82 can be positioned on the lid 14 proximal cup connecting means 61, while the one or more protrusions 81 are positioned on the connection wall 21 proximal the lid connecting means 61. As described above, proximal enables the preferred location above the connecting means (22 and 61), but also below connecting means (22 and 61). While these embodiments having one or more protrusions 81 on the inner wall 113 would require an undercut during molding, it could be achieved with collapsible core tools permitting side action movement.

The lead-in 83 offers multiple advantages, such as an alignment feature between the lid 14 and cup 12 to ensure the cup connecting means 61 and lid connecting means 22 are positioned for proper connection, and also to improve molding ease such that a blind feature is not required and thus a simpler tool can be used without side action. Preferably, the number of one or more recesses 82 is equal to the number of the one or more protrusions 81. In some embodiments, the one or more recesses 82 and the one or more protrusions 81 are at least two. In further embodiments, the one or more recesses 82 and the one or more protrusions are at least three. In yet further embodiments, the one or more recesses 82 and the one or more protrusions are at least four.

The relative rotational movement required to connect and disconnect the cup is substantially the same but in a reverse sequence. From a torque perspective, the total torque and/or highest torque required to fully-assemble the cup assembly 10 is optionally different from the total torque and/or highest torque required to disassembly the cup assembly 10. For instance, when fully assembled, the cup assembly 10 potentially has a vacuum (and optionally surface tension) that must be overcome in addition to force required to rotate the lid 14 with respective to the cup 12. This additional force (vacuum, and/or surface tension) is additive to the rotational movement (and force) required to separate the cup 12 with respect to the lid 14. While initially, a higher level of torque is required to begin relative rotational movement between the cup 12 and lid 14, after some relative rotational movement, the torque required to continue separation between the cup 12 and lid 14 is smaller. Towards the end of the relative rotational movement—where the torque is small—the flexible valve 48 will flex and begin to move towards a separated state from the cup upper portion including either or both of the lip 13 and platform 17. In order to achieve full separation of the outer periphery 49 of flexible valve 48 from the cup upper portion, higher torque may be required to overcome any additional force caused by vacuum and/or surface tension. This is correlates to the force to activate the air vent 58. It is desirable for the peak force required to disassemble cup assembly 10 to be between about 4 in-lb and about 20 in-lb. In some embodiments, the torque required to fully-assembly the cup assembly 10 is between about 3 in-lb to about 8 in-lb, and more preferably, between about 3 in-lb and about 6 in-lb. In some embodiments, the torque required to fully disassembly the cup assembly 10 is between about 3 in-lb and about 8 in-lb, and more preferably between about 4 in-lb and about 8 in-lb.

In some embodiments, the relative rotational movement required to connect or disconnect the lid 14 from the cup 12 is less than or equal to 360 degrees (or a full turn). In some embodiments, the relative rotational movement to connect or disconnect the lid 14 from the cup 12 is less than or equal to about 180 degrees (or a half turn). In some embodiments an offset ratio is defined as peripheral length of the turn required to go from an unsecured lid 14 positioned on the cup (or container) 12 such that he lid can be removed, to a fully-assembled (or closed) cup (or container) assembly 10, to the peripheral length of the offset 86. The offset ratio is between about 10:1 to about 1:1, or less than or equal to about 8:1, or less than or equal to about 5:1, or less than or equal to about 3:1, or between about 1.1 and about 8:1.

In some embodiments, the baffle 59 and flexible valve 17 portions, or the first portion 50 and second portion 54, are unitary and not intended to be separable. Such configuration requires a flexible material with sufficient rigidity to permit deflection without complete distortion of the flexible valve 17 and baffle 59 when a force is applied by a child.

A unique aspect of these embodiments is that the container 12 and/or lid 14 is interchangeable amongst other containers 12 and/or lids 14. Said differently, this unique spill mitigating container assembly 10 includes this unique spill mitigating lid 14, as well as other types of container lids 14. For instance, types of lid 14 include cover 16 or snacker lid 15 having flexible portions 78 (such as flexible petals or a flexible diaphragm) that enable access to the contents of the container 12 by the user's hand. These other lids 14 afford the user the ability to bring one container 12 and have it multi-purposed depending on the needs of the child.

In further embodiments, a single container 12 is connectable to two or more lids 14. For instance, the spill mitigating lid 14 is connected directly to container 12. Cover 16 is connectable to the container 12 over spill mitigating lid 14. Alternatively, cover 16 can be applied over snacker lid 15 in a similar fashion. Cover 16 is connectable via a snap-fit utilizing a lip 22*b*, or as otherwise contemplated by connection features in the present disclosure. In these embodiments, the cover 16 keeps the spill mitigating lid 14 (or snacker lid 15) from becoming soiled during storage or travel. In another embodiment, snacker lid 15 is connectable to the container 12. Snacker lid 15 is provided with lid connecting means 22 on an inner surface 214, similar to that of the container 12, and also has container connecting means 61 on an outer surface 212. Container connecting means 61 on inner surface 212 is proximal the upper end 216 of the snacker lid 15, while lid connecting means 22 on outer surface 214 is proximal lower end 218 of the snacker lid 15. Spill mitigating lid 14 is connectable to the connecting features 22 of snacker lid 15. In this configuration, a user can fill the container 12 with fluid and the fluid will bypass or deflect the flexible portions 78 (and through central opening 80) of snacker lid 15, then through fluid opening(s) 57 upon a child's application of a force on flexible valve 48 of spill mitigating lid 14.

In some embodiments, a variety of lid 14 options are available to the user and/or caretaker that are compatible with the cup (or container) 12 of the present disclosure. This reduces confusion with assembly of cups and lids and reduces the number of parts theoretically needed (i.e. having five different lid options and four cups those five lids matingly engage with). Furthermore, the user can have two or three different container or cup 12 options with only three or four total container assembly 10 components, as opposed to prior art cups that require a minimum of three or four components to function as a single cup.

Embodiments where at least one lid 14 is a cover 16, the height 42 of the cover 16 is between about 2 mm and about 60 mm, and more preferably between about 2 mm and about 20 mm, or up to about 15 mm. Embodiments where at least one lid 14 is a snacker lid 15, the height 42 of the snacker lid 15 is about 10 mm to about 60 mm, and preferably between about 10 mm and about 20 mm. In certain embodiments, the lid 12 can act as a collar, thereby enabling two cup sizes—a short cup and a tall cup. In some embodiments, the cup 12 has a lip 13 and the lid 14 also has a lip 13.

The lid 12 has a cup connecting means that may require the use of a gasket 99 to mitigate against leaks. Gasket 99 is stretchable such that it can be removed for cleaning. Gasket 99 is positioned adjacent or within a shoulder 100 of either the cup (or container) 12 or the lid 14 such that it remains connected to the cup assembly 10 unless the user specifically attempts to remove it for cleaning.

The cup assembly 10 of the present disclosure can have a variety of purposeful configurations in order to please the child who is learning how to drink properly, and to also assist the caretaker in monitoring the amount of nourishment is within the cup or container 12. For example, the cup or container 12 may be fully or partially translucent, serving the purpose of enabling the caretaker to monitor the level of the contents in the cup or container 12 and also looking more akin to adult drinking vessels (likely causing the child to be proud of his/her accomplishment of using an adult-esque cup or container 12). The lid 14 is optionally fully or partially translucent for similar reasons, but also such that the child can see the contents of the cup or container 12 when it is being tipped in front of the child's face to access the contents therein. As the child seeks to establish the right amount of pressure or force to exert via his or her lips in order to allow fluid to pass between the lip and the flexible valve 28, seeing the water level move as the cup or container 12 is tipped helps to guide the child.

It is to be understood that the above description is intended to be illustrative, and not restrictive. For example, the above-described embodiments (and/or aspects thereof) may be used in combination with each other. Many other embodiments will be apparent to those of skill in the art upon reviewing the above description. The scope of the invention should, therefore, be determined with reference to the appended claims, along with the full scope of equivalents to which such claims are entitled.

Where the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. For instance, in some embodiments, the lid may include multiple components that are connected such that they do not require separation for cleaning. Additionally, in some embodiments, the lip of the cup is configured on a removable lid assembly, such that the lid is attachable to the cup as a lid or collar, where the lid is one or more parts that do not require separation for cleaning. Therefore, it is intended that the present disclosure not be limited to the particular embodiment(s) disclosed herein as the best mode contemplated for carrying out this present disclosure.

Throughout the present disclosure, the terms "a" or "an" are used, as is common in patent documents, to include one or more than one. In this document, the term "or" is used to refer to a nonexclusive or, unless otherwise indicated. In the appended claims, the terms "including" and "in which" are used as the plain-English equivalents of the respective terms "comprising" and "wherein." Moreover, in the following claims, the terms "first," "second," and "third," etc., as they may be included, are used merely as labels, and are not intended to impose numerical requirements on their objects. In the Detailed Description provided above, various features may be grouped together to streamline the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separate embodiment.

The invention claimed is:

1. A cup assembly, comprising:

a cup having a body having an inner surface defining a storage volume, the body have an outer surface that is opposite the inner surface, the cup body having an upper end defined by a cup lip, the cup having a lid connecting means located below the cup lip and on the inner surface of the cup body, the cup lip being upward and adjacent a platform on the inner surface of the cup body; and a lid having a lid vertical axis, the lid having an upper portion and a lower portion, the upper portion comprising a flexible valve defining an upper outer periphery of the lid, the flexible valve having an upper valve surface and a lower valve surface, the lower portion having a baffle with one or more openings therethrough, each of the one or more openings defining an opening vertical axis that is substantially parallel to the lid vertical axis, the lid thereby having one or more opening vertical axes the upper portion and the lower portion connected to each other about a center portion of the lid, the lid having a cup connecting means located on the lower portion;

wherein a clearance is defined as a distance measured along the opening vertical axis between a plane defined by a top surface of the lower portion where the one or more openings extends through the lower end of the upper portion that is directly above the one or more openings, the clearance of at least one of the one or more openings being at least 0.125 inches such that the upper portion and the lower portion do not need to be separated to be cleaned; and wherein the cup connecting means matingly engages the lid connecting means to securely connect the lid to the cup such that the outer upper periphery of the flexible valve engages at least one of the cup lip and platform to mitigate against spills, and wherein when a force is applied to the flexible valve, the flexible valve deflects to form one or more channels between the inner surface of the cup and the flexible valve to enable withdrawal of fluid from the cup assembly.

2. The cup assembly according to claim 1, further comprising one or more spaces located between the cup lip and/or the platform and the flexible valve thereby creating one or more channels through which fluid can be withdrawn upon the application of force to the flexible valve.

3. The cup assembly according to claim 1, wherein the cup connecting means are one or more external threads and the lid connecting means are one or more internal threads.

4. The cup assembly according to claim 1, wherein a lid height of the lid is less than or equal to a cup height of the cup when the lid and the cup are fully connected.

5. The cup assembly according to claim 1, wherein the largest outer periphery of the lid defines a lid outer perimeter, wherein the largest cup outer periphery defines a cup outer perimeter, wherein the lid outer perimeter is less than or equal to the cup outer perimeter when the lid and the cup are fully connected.

* * * * *